US012312869B2

(12) United States Patent
Lajesic

(10) Patent No.: US 12,312,869 B2
(45) **Date of Patent: *May 27, 2025**

(54) TWO-PART DRILLING AND RUNNING TOOL

(71) Applicant: Halliburton Energy Services, Inc., Houston, TX (US)

(72) Inventor: Borisa Lajesic, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/083,826

(22) Filed: Dec. 19, 2022

(65) Prior Publication Data

US 2023/0265719 A1 Aug. 24, 2023

Related U.S. Application Data

(60) Provisional application No. 63/311,493, filed on Feb. 18, 2022.

(51) Int. Cl.

| | |
|---|---|
| ***E21B 10/64*** | (2006.01) |
| ***E21B 7/06*** | (2006.01) |
| ***E21B 10/60*** | (2006.01) |
| ***E21B 10/62*** | (2006.01) |
| ***E21B 41/00*** | (2006.01) |

(52) U.S. Cl.

CPC ..... *E21B 10/64* (2013.01); *E21B 7/061* (2013.01); *E21B 10/602* (2013.01); *E21B 10/62* (2013.01); *E21B 41/0035* (2013.01)

(58) Field of Classification Search

CPC ..... E21B 10/26; E21B 10/62; E21B 10/602; E21B 10/265; E21B 10/64; E21B 10/42; E21B 10/43

See application file for complete search history.

(56) References Cited

U.S. PATENT DOCUMENTS

| | | | | |
|---|---|---|---|---|
| 2001/0040054 | A1 | 11/2001 | Haugen et al. | |
| 2003/0098152 | A1 | 5/2003 | Kennedy et al. | |
| 2008/0173481 | A1* | 7/2008 | Menezes | E21B 10/62 175/50 |
| 2012/0261193 | A1* | 10/2012 | Swadi | E21B 7/061 175/75 |
| 2015/0361764 | A1* | 12/2015 | Cronley | E21B 23/06 166/255.2 |
| 2016/0237770 | A1 | 8/2016 | Korf | |

(Continued)

FOREIGN PATENT DOCUMENTS

| | | | |
|---|---|---|---|
| EP | 1222357 | B1 | 4/2004 |
| WO | 2012118992 | A2 | 9/2012 |

*Primary Examiner* — Kristyn A Hall

(74) *Attorney, Agent, or Firm* — Scott Richardson; Parker Justiss, P.C.

(57) ABSTRACT

Provided is a two part drilling and running tool, a well system, and a method for forming a well system. The two part drilling and running tool, in one aspect, includes a conveyance, and a smaller assembly coupled to an end of the conveyance. The two part drilling and running tool, in accordance with this aspect, further includes a larger bit assembly slidably coupled to the conveyance, the smaller assembly and larger bit assembly configured to slidingly engage one another downhole to form a combined bit assembly.

33 Claims, 35 Drawing Sheets

(56) References Cited

U.S. PATENT DOCUMENTS

| | | | | |
|---|---|---|---|---|
| 2023/0265718 | A1* | 8/2023 | Lajesic | E21B 10/44<br>166/117.6 |
| 2023/0265743 | A1* | 8/2023 | Lajesic | E21B 23/01<br>166/382 |

* cited by examiner

TWO-PART DRILLING AND RUNNING TOOL

CROSS-REFERENCE TO RELATED APPLICATION

This application claims the benefit of U.S. Provisional Application Ser. No. 63/311,493, filed on Feb. 18, 2022, entitled "TWO-PART DRILLING AND RUNNING TOOL," commonly assigned with this application and incorporated herein by reference in its entirety.

BACKGROUND

The unconventional market is very competitive. The market is trending towards longer horizontal wells to increase reservoir contact. Multilateral wells offer an alternative approach to maximize reservoir contact. Multilateral wells include one or more lateral wellbores (e.g., secondary wellbores) extending from a main wellbore (e.g., primary wellbore). A lateral wellbore is a wellbore that is diverted from the main wellbore or another lateral wellbore.

Lateral wellbores are typically formed by positioning one or more deflector assemblies (e.g., whipstock assemblies) at desired locations in the main wellbore (e.g., an open hole section or cased hole section) with a running tool. The deflector assemblies are often laterally and rotationally fixed within the primary wellbore using a wellbore anchor.

BRIEF DESCRIPTION

Reference is now made to the following descriptions taken in conjunction with the accompanying drawings, in which.

DETAILED DESCRIPTION

Figure 1:
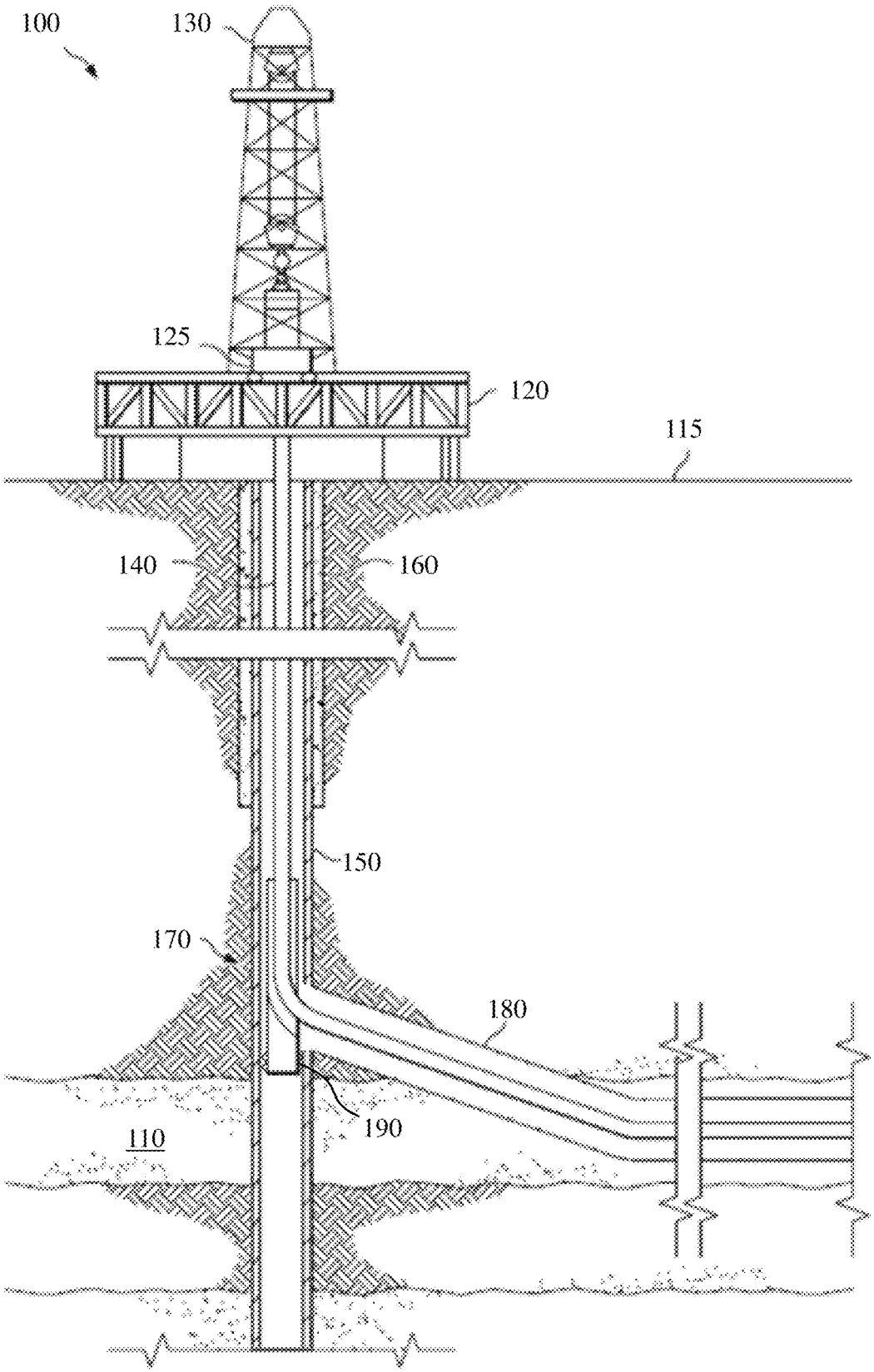
FIG. 1 illustrates a schematic view of a well system designed, manufactured and operated according to one or more embodiments disclosed herein.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water, such as ocean or fresh water.

The disclosure addresses the challenge of running a whipstock assembly on a mill, for example in an effort to reduce trip count. Current designs for shear bolting a whipstock assembly to a mill leave the shear bolt vulnerable to combined loading, which can cause unreliable shear values. Also, current shear bolts are unsuitable for deploying whipstock assembly in extremely deep wells because of the low shear ratings. In addition, the disclosure allows for certain tools to be activated with pressure or flow, further improving efficiencies in the construction of a multilateral junction.

With this in mind, the present disclosure provides a two part drilling and running tool (e.g., two-part lead bit assembly) that can be used to run a whipstock assembly downhole. In at least one embodiment, the smaller assembly (e.g., downhole/smaller bit assembly) is connected to the whipstock assembly and functions as a running tool. The smaller assembly, in certain embodiments, also seals into the whipstock assembly allowing pressure or flow, or a combination thereof, to be used to activate or otherwise interact with one or more tools below the whipstock assembly. Once released, the smaller assembly pulls back and connects to a larger bit assembly (e.g., uphole/larger bit assembly) thereby forming a new combined bit assembly (e.g., that looks and functions like a conventional lead mill). For purposes of the present disclosure, the term bit assembly is intended to encompass both mill assemblies and drill bit assemblies. Following the successful creation of the exit and the drilling of the lateral, the lateral completion could be installed and then tied together with the main bore by installing a level 5 junction.

Heretofore, a two part drilling and running tool consisting of two independent assemblies (e.g., two independent bit assemblies) has not been used, and particularly where the smaller assembly (e.g., smaller bit assembly) can function as a running tool for a whipstock assembly. The two part drilling and running tool described herein ensures reliable deployment of a whipstock assembly. Also, it greatly increases the mechanical ratings that can be achieved while running in hole, thereby allowing the whipstock assembly to be deployed into deeper or highly deviated wells. It would also be feasible to connect more components to the whipstock assembly without risking premature shearing of the shear bolt.

One embodiment of the disclosure would feature a smaller assembly and a larger bit assembly. In accordance with at least one embodiment of the disclosure, the smaller assembly is a smaller bit assembly having one or more cutting features (e.g., teeth, blades, etc.) thereon. The smaller assembly, in one embodiment, would be connected to a tubular that extends through the larger bit assembly and is then connected to the rest of the drill string, or perhaps to a downhole motor directly. In at least one embodiment, the smaller assembly is sized such that it can wholly or partially fit into the bore of the whipstock assembly, such that in one embodiment it may connect to the whipstock assembly. Many different connection methods can be used, perhaps the simplest being a shear feature such as a shear bolt.

The smaller assembly, in one or more embodiments, could also feature the ability to seal into the whipstock assembly. In one simple embodiment, the smaller assembly would have a seal surface that stabs into a seal in the whipstock assembly. Once the whipstock assembly has been positioned in the well, pressure could be applied to activate an anchoring assembly. In reentry or open hole applications this is often a requirement, as there would not be a preposition datum in the well such as a latch coupling. In yet another embodiment, the smaller assembly would have a seal that stabs into a seal surface of the whipstock assembly.

In at least one embodiment, the whipstock assembly would be run in hole to the depth datum in the well and then latched in. One possible embodiment of this would be a multilateral latch coupling, or another similar latch. Unlike existing shear bolt designs, here the shear bolts of certain embodiments herein would be protected from combined loading. For example, different (e.g., simple) profiles can be included into the design of the smaller assembly and the bore of the whipstock assembly to ensure that the shear bolt will only shear under a single loading condition, such as for example only one of compression, tension, or torque.

In one or more embodiments, a bolt action profile is employed, whereby the shear features are sheared with a single hand torque (e.g., right hand torque). When locked in, the smaller assembly is trapped in tension and compression transmitting all loads directly to the whipstock assembly bypassing the shear bolts completely. In at least this embodiment, right hand rotation shears the shear features and moves the raised profiles on the OD of the smaller assembly into a channel that allows the smaller assembly to be pulled out of the whipstock assembly.

In at least one second embodiment, a no-go and splines are used, such that the shear features would be isolated from all compressive loads and all torque, only allowing the shear features to shear in response to tensile loads. In at least one third embodiment, a third profile is possible that isolates the shear bolts from tensile and torque loads and shears the smaller assembly with a compressive load. This profile could be described as a J-slot, where down movement and then rotation releases the smaller assembly from the whipstock assembly. The three simple profiles described could all be different options offered depending on the particular requirements of the well.

Accordingly, as described above, the smaller assembly can be designed to shear only if supplied a specific one of compression, tension or torque, and not shear if supplied the other two of compression, tension or torque. In contrast, currently a shear bolt connecting a lead mill to the tip of the whipstock assembly may shear if supplied two or more, if not any one, of compression, tension or torque, as well as a collection of these three, contributing to fatigue and cyclical loading.

In at least one embodiment, the larger bit assembly, is also secured to the tip of the whipstock assembly. Those familiar with multilateral shear bolt systems will recognize this as the traditional placement of a shear bolted mill. Nevertheless, since the larger bit assembly is not used for running the whipstock assembly, a robust connection at the larger bit assembly is not required in certain embodiments, and thus may be dispensed with.

The larger bit assembly, in at least one embodiment, only needs to remain stationary relative to the smaller assembly as the smaller assembly is being pulled back (e.g., uphole). Therefore, many different methods may be used to hold the larger bit assembly stationary. Several other non-limiting examples are listed below. As the smaller assembly is pulled back, it mostly enters the larger bit assembly. At this point, the external appearance of the two bit assemblies put together would very closely resemble that of a conventional multilateral lead mill in one or more embodiments. Since existing lead mills have been developed over many years it is presumed that this shape is optimized for the task of creating an exit from the main bore of a well. However, variations may be possible, either to incorporate the two-part design or to keep up with latest designs in conventional single part mills.

Once the smaller assembly has been fully retracted into the larger bit assembly it can be secured to the larger bit assembly for the milling operation. In at least one embodiment, a simple snap ring falls into a groove in the smaller assembly, thereby securing (e.g., laterally securing) the smaller assembly within the larger bit assembly. Many alternate methods are obviously possible, such as spring-loaded pins, a thread, or an interference fit between the two bit assemblies. In at least one embodiment, an external profile on the smaller assembly could mate with an internal profile in the larger bit assembly to lock the two bit assemblies together (e.g., torsionally securing the smaller assembly and the larger bit assembly).

At this point the larger bit assembly may be disconnected from the whipstock assembly tip and a normal window can be milled in the casing and/or formation as is current industry practice. As is sometimes the practice with milling windows, secondary mills may be added to follow the lead mill to ensure proper window geometry. Likewise multiple trips may be required to successfully mill a window. In those cases, extra mills or trips could be performed as is done today. Thereafter, the remainder of the multilateral construction may be completed, for example including placing a multilateral junction including a mainbore leg and a lateral bore leg at the junction between the main wellbore and the lateral wellbore.

Up to this point, the use of a two part drilling and running tool has been discussed for creating an exit window from a cased mainbore. An alternate use for this new technology is to sidetrack from an open-hole main bore. In this alternate use, the bit assembly would be more appropriately called a drill bit, as it would be drilling formation to exit the main bore rather milling casing. This would be useful for simple sidetracking where the main bore may need to be abandoned, or it may be used during the construction of an open-hole multilateral junction. In this use, the smaller assembly and larger bit assembly would be designed differently than what is shown here to closely resemble a drill bit instead of a mill bit. This would necessitate certain changes to the external cutting features, which should be understood to not deviate from the core features described herein.

Another possible deviation is that the smaller assembly may be secured to the whipstock assembly with different methods known to the industry. For example, the smaller assembly could be secured to the whipstock assembly using various different running, retrieving, and/or shifting tools. Nevertheless, the shear feature concept presented here is thought to be perhaps the simplest, most robust, and predictable of the different methods.

In at least one embodiment, the smaller assembly may feature one of several different mechanical movements or a combination thereof that connect it to the whipstock assembly. For example, the smaller assembly could include radially extending dogs to transmit all, or some of the mechanical loads (e.g., compression, tension, or torsion) to the whipstock assembly. Another method is to use a collet that locks the smaller assembly into the whipstock assembly axially in combination with a profile to hold torque. The smaller assembly may also be simply threaded into the whipstock assembly, and then once the whipstock assembly is positioned and locked into the mainbore it is unthreaded. The threads could also be used in combination with the above discussed locking methods to ensure it does not unthread prematurely.

Alternatively, the above concepts could be incorporated into the body of the whipstock assembly instead. Meaning for example the radial dogs extend inward into the smaller assembly and then retract to release. As should be understood from the many examples, many different mechanisms for securing and releasing the smaller assembly and the whipstock assembly together may be used. As such, the present disclosure should not be limited to one specific securing and releasing mechanism, as there are many others that can be substituted without deviating from the core idea of the two-part mill.

Similarly, the larger bit assembly may be secured to the whipstock assembly in many ways. Since the larger bit assembly is not used as the running tool in one or more embodiments, the connection need not be robust. In fact, the larger bit assembly may simply be loose and rely upon friction between it and the casing or open hole to remain stationary as the smaller assembly is pulled back. While the sole use of friction is unlikely, it is included to illustrate that there is great flexibility in securing the larger bit assembly with the whipstock assembly.

As mentioned above, there are many different methods and mechanisms known to the industry for securing tubular tools to each other. This also applies when it comes to securing the smaller assembly to the larger bit assembly in preparation for milling. For applications where the whipstock assembly needs to be removed following the drilling of the short rat hole, the present concept may be set up to allow the smaller assembly to disconnect from the whipstock assembly, connect to the larger bit assembly, and then following the completion of the milling/drilling, disconnect from the larger bit assembly again and then again reconnect to the whipstock assembly for its retrieval.

In at least one embodiment, the two part drilling and running tool can drill a lateral section on its own without the need for dedicated drill out run. Incorporating one of the mechanical movements described above into the smaller assembly would allow for this functionality.

Additionally, there are many anchoring assembly mechanisms (e.g., within Halliburton multilateral technology alone there are 4 different anchoring assembly mechanisms) for providing the datum for the construction of a multilateral junction. The latch coupling discussed herein is just one, but based on the particular well and requirements, any of the other methods would work just as well and not impact the use of the two part drilling and running tool presented here. For example, other hydraulic actuated anchor assemblies, including traditional anchor assemblies and screen based anchor assemblies, could be used as the anchoring assembly mechanism.

One or more hydraulic actuated anchoring assemblies designed according to the present disclosure may have a setting range of 15% or more of the run-in-hole diameter. For example, if the wellbore anchoring assembly were to have a diameter (x) when run in hole, the expanded diameter (x') could be 1.15× or more (e.g., 8.5" to 10" or more). Washed out/caved in areas or uneven ID in general is often seen when surveying a drilled section and finding a suitable location/depth for an open hole anchoring assembly can thus be difficult. Furthermore, the traditional open hole wellbore anchoring assembly relies on a certain formation strength of the rock in order to hold the required axial and torsional loads.

FIG. 1 is a schematic view of a well system 100 designed, manufactured and operated according to one or more embodiments disclosed herein. The well system 100 includes a platform 120 positioned over a subterranean formation 110 located below the earth's surface 115. The platform 120, in at least one embodiment, has a hoisting apparatus 125 and a derrick 130 for raising and lowering one or more downhole tools including pipe strings, such as a drill string 140. Although a land-based oil and gas platform 120 is illustrated in FIG. 1, the scope of this disclosure is not thereby limited, and thus could potentially apply to offshore applications. The teachings of this disclosure may also be applied to other land-based and/or water-based well systems different from that illustrated.

As shown, a main wellbore 150 has been drilled through the various earth strata, including the subterranean formation 110. The term "main" wellbore is used herein to designate a primary wellbore from which another secondary wellbore is drilled. It is to be noted, however, that a main wellbore 150 does not necessarily extend directly to the earth's surface, but could instead be a branch of yet another lateral wellbore. A casing string 160 may be at least partially cemented within the main wellbore 150. The term "casing" is used herein to designate a tubular string used to line a wellbore. Casing may actually be of the type known to those skilled in the art as a "liner" and may be made of any material, such as steel or composite material and may be segmented or continuous, such as coiled tubing. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

A whipstock assembly 170 according to one or more embodiments of the present disclosure may be positioned at a location in the main wellbore 150. Specifically, the whipstock assembly 170 could be placed at a location in the main wellbore 150 where it is desirable for a lateral wellbore 180 to exit. Accordingly, the whipstock assembly 170 may be used to support a drilling/milling tool used to penetrate a window in the main wellbore 150. In at least one embodiment, once the window has been milled and a lateral wellbore 180 formed, the whipstock assembly 170 may be retrieved and returned uphole by a retrieval tool, in some embodiments in only a single trip.

In some embodiments, an anchoring assembly 190 may be placed downhole in the wellbore 150 to support and anchor downhole tools, such as the whipstock assembly 170, for maintaining the whipstock assembly 170 in place while milling the casing 160 and/or drilling the lateral wellbore 180. The anchoring assembly 190, in accordance with the disclosure, may be employed in a cased section of the main wellbore 150, or may be located in an open-hole section of the main wellbore 150, as is shown. As such, the anchoring assembly 190 in at least one embodiment may be configured to resist at least 6,750 newton meters (Nm) (e.g., about 5,000 lb-ft) of torque. In yet another embodiment, the anchoring assembly 190 may be configured to resist at least 13,500 newton meters (Nm) (e.g., about 10,000 lb-ft) of torque, and in yet another embodiment configured to resist at least 20,250 newton meters (Nm) (e.g., about 15,000 lb-ft) of torque. Similarly, the anchoring assembly 190 may be configured to resist at least 1814 kg (e.g., about 4,000 lb) of axial force. In yet another embodiment, the anchoring assembly 190 may be configured to resist at least 4536 kg (e.g., about 10,000 lb) of axial force, and in yet another embodiment the anchoring assembly 190 may be configured to resist at least 6804 kg (e.g., about 15,000 lb) of axial force.

In the illustrated embodiment, the anchoring assembly 190 is a latch coupling. In this embodiment, the latch coupling (e.g., a profile in the casing engages with a reciprocal profile in the whipstock 170 assembly) anchors the whipstock assembly 170, and any other features hanging there below (e.g., screens, valves, etc.) in the casing string 160. Once the anchoring assembly 190 reaches a desired location in the main wellbore 150, the reciprocal profile in the whipstock assembly 170 may be activated to engage with the latch coupling profile in the casing string 160, thereby setting the anchoring assembly 190.

In some other embodiments, the anchoring assembly 190 may be a hydraulically activated anchor. In this embodiment, once the anchoring assembly 190 reaches a desired location in the main wellbore 150, fluid pressure may be applied to set the hydraulic anchoring assembly. In at least one embodiment, the hydraulically activated anchoring assembly includes two or more hydraulic activation chambers, and the activation fluid is supplied to the two or more hydraulic activation chambers (e.g., through a two-part milling assembly coupled to the whipstock assembly 170) to move the two or more hydraulic activation chambers from the first collapsed state to the second activated state and engage a wall of the main wellbore 150. The anchoring assembly 190 may also include, in some embodiments, an expandable medium positioned radially about the two or more hydraulic activation chambers. In some aspects, the expandable medium may be configured to grip and engage the wall of the main wellbore 150 when the two or more hydraulic activation chambers are in the second activated state. Notwithstanding, other fluid activated anchoring assemblies (e.g., other than those having two or more hydraulic activation chambers) may be used and remain within the scope of the disclosure. In at least one other embodiment, the hydraulically activated anchoring assembly includes one or more hydraulic activation slips, and the activation fluid is supplied to the one or more hydraulic activation slips (e.g., through a two-part milling assembly coupled to the whipstock assembly 170) to move the one or more hydraulic activation slips from the first collapsed state to the second activated state and engage the wall of the main wellbore 150.

In at least one embodiment, a multilateral junction is positioned at an intersection between the resulting main wellbore 150 and the resulting lateral wellbore 180. In accordance with one embodiment, the multilateral junction might include a main bore leg forming a first pressure tight seal with the main bore completion and a lateral bore leg forming a second pressure tight seal with the lateral bore completion, such that the main bore completion and the lateral bore completion are hydraulically isolated from one another. What results, in one or more embodiments, is an open hole TAML Level 5 pressure tight junction.

Figure 2A:
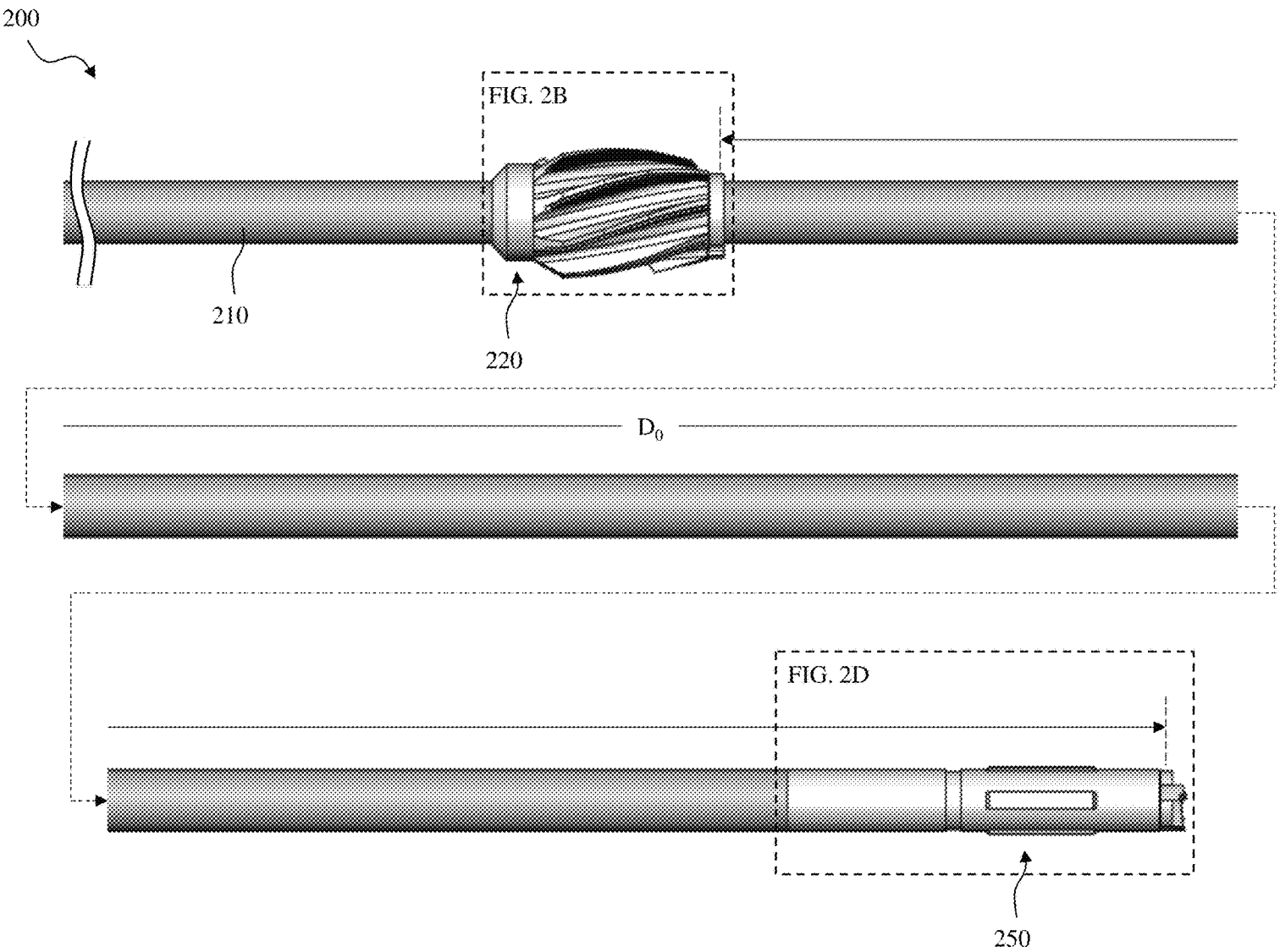
FIGS. 2A through 2E illustrate various different views of a two part milling and running tool designed, manufactured and operated according to one or more embodiments of the disclosure.

Turning to FIG. 2A, illustrated is a side view of a two part milling and running tool 200 designed, manufactured and operated according to one or more embodiments of the disclosure. The two part milling and running tool 200, in the illustrated embodiment, includes a conveyance 210 having a larger bit assembly 220 and a smaller assembly 250 coupled thereto. The phrase "bit assembly," as used herein, is intended to include both milling assemblies (e.g., as might be used to mill through casing) and drill bit assemblies (e.g., as might be used to drill through formation), as well as any combination of the two.

The conveyance 210, in at least one embodiment, is a tubular, such as jointed pipe or coiled tubing. In the illustrated embodiment of FIG. 2A, the smaller assembly 250 is coupled to a downhole end of the conveyance 210, whereas the larger bit assembly 220 is in sliding engagement with the conveyance 210. Accordingly, assuming that something (e.g., friction, a shear feature, etc.) is holding the larger bit assembly 220 in place, as the conveyance is moved the smaller assembly 250 may slide relative to the larger bit assembly 220. For instance, if the conveyance 210 were withdrawn uphole, the larger bit assembly 220 would slide along the conveyance 210, thereby allowing the smaller assembly 250 to slide toward the larger bit assembly 220. As will be discussed in greater detail below, the two part milling and running tool 200 may be used to deploy a whipstock, and thus be coupled to the whipstock when running downhole. The coupling of the milling and running tool 200 to the whipstock, in at least one embodiment, would prevent the smaller assembly 250 from sliding toward the larger bit assembly 220 during the run-in-hole phase. Only when the coupling is removed or broken (e.g., sheared) would the smaller assembly 250 be allowed to slide toward the larger bit assembly 220.

In the illustrated embodiment of FIG. 2A, the two part milling and running tool 200 is positioned in the run-in-hole position. In this run-in-hole position, the larger bit assembly 220 would be spaced apart from the smaller assembly 250 by a distance ($D_0$). In at least one embodiment, the distance ($D_0$) approximates the length of the whipstock that the two part milling and running tool 200 is coupled to. According to this embodiment, the smaller assembly 250 might couple proximate a downhole side of the whipstock, whereas the larger bit assembly 220 might couple proximate an uphole side of the whipstock. Thus, in at least one embodiment, the distance ($D_0$) is at least 2 meters. In yet another embodiment, the distance ($D_0$) is at least 4 meters, and in even another embodiment the distance ($D_0$) is at least 5 meters.

Figure 2B:
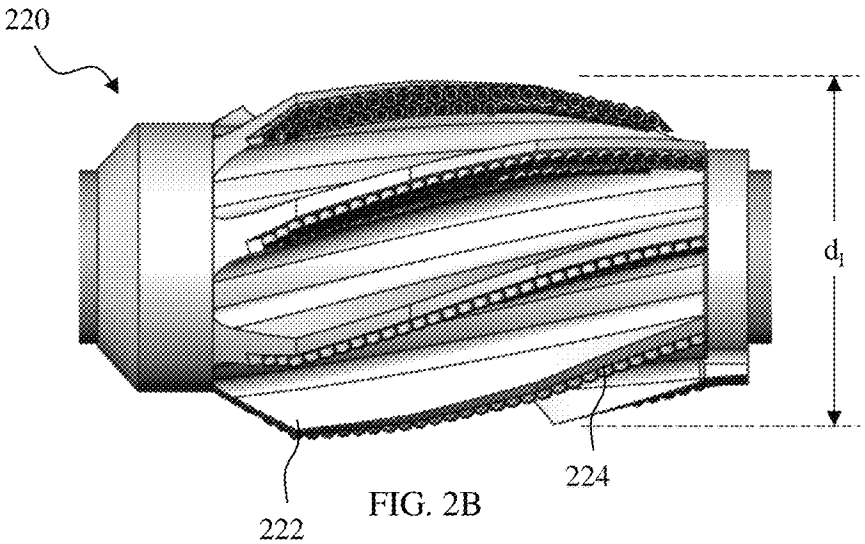

Turning now to FIG. 2B, illustrated is an enlarged side view of the larger bit assembly 220 of FIG. 2A. As is evident in FIG. 2B, the larger bit assembly 220 may have one or more blades 222 and one or more cutting features 224 thereon. While specific blades 222 and cutting features 224 are illustrated in FIG. 2B, any currently known or hereafter discovered blades and cutting features may be used and remain within the scope of the disclosure. The larger bit assembly 220, in the illustrated embodiment, includes a cutting diameter ($d_l$). In at least one embodiment, the cutting diameter ($d_l$) approximates the size of an opening (e.g., in the casing and/or formation) forming a lateral wellbore.

Figure 2C:
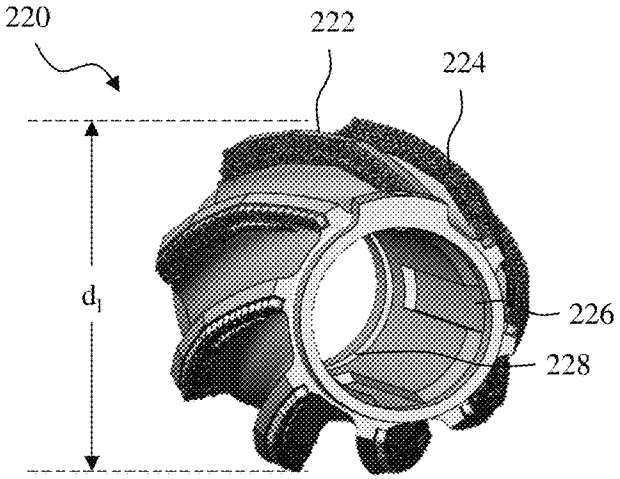

Turning now to FIG. 2C, illustrated is an isometric view of one embodiment of an internal profile of the larger bit assembly 220 of FIG. 2A. In the illustrated embodiment of FIG. 2C, the larger bit assembly 220 additionally includes one or more internal profiles 226. In at least one embodiment, the internal profiles 226 are configured to engage with external profiles of the smaller assembly 250 when the smaller assembly 250 has slid relative and proximate to the larger bit assembly 220. Furthermore, in at least one embodiment, the larger bit assembly 220 may include a lock ring profile 228, which may be configured to hold a lock ring (not shown) that could ultimately engage with an associated lock ring profile in the smaller assembly 250.

Figure 2D:
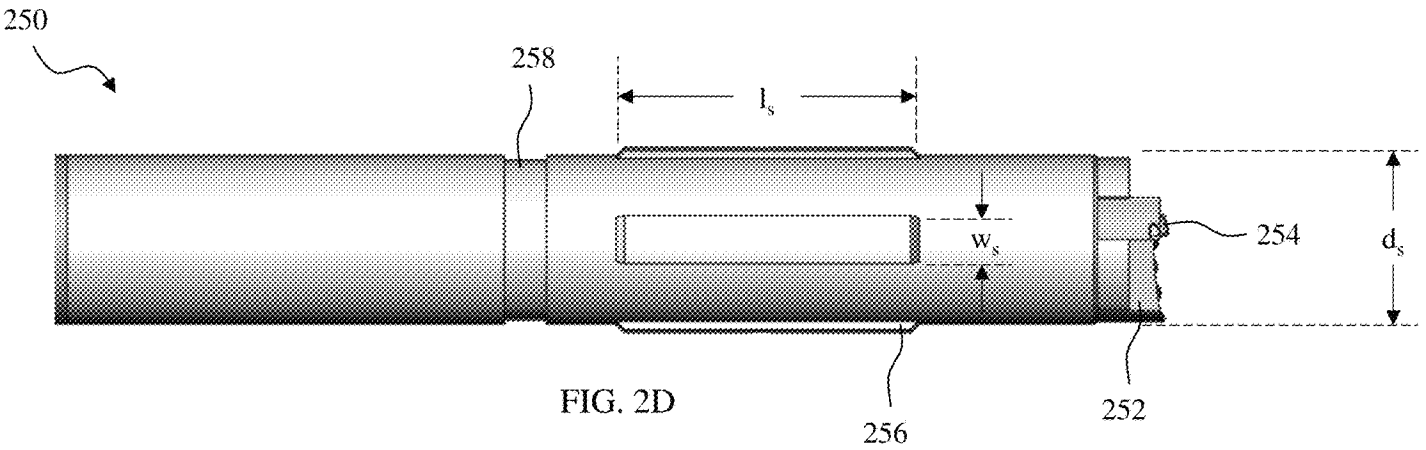

Turning now to FIG. 2D, illustrated is an enlarged side view of the smaller assembly 250 of FIG. 2A. As is evident in FIG. 2D, the smaller assembly 250 may have one or more blades 252 and one or more cutting features 254 thereon (e.g., along a nose thereof). While specific blades 252 and cutting features 254 are illustrated in FIG. 2D, any currently known or hereafter discovered blades and cutting features may be used and remain within the scope of the disclosure. The smaller assembly 250, in the illustrated embodiment, includes a cutting diameter ($d_s$). In at least one embodiment, the cutting diameter ($d_s$) is at least 10 percent less than the cutting diameter ($d_l$). In at least one embodiment, the cutting diameter ($d_s$) is at least 25 percent less than the cutting diameter ($d_l$), and in yet another embodiment at least 50 percent less than the cutting diameter ($d_l$).

The smaller assembly 250, as shown in FIG. 2D, may additionally include one or more external profiles 256. In at least one embodiment, not only are the one or more external profiles 256 configured to engage with the one or more internal profiles 226 of the larger bit assembly 220, the one or more external profiles 256 may be configured to engage with associated internal profiles in the whipstock that the smaller assembly 250 is engaged with. In the illustrated embodiment of FIG. 2D, the one or more external profiles 256 have a length ($l_s$) and a width ($w_s$). The length ($l_s$) and the width ($w_s$) may be used to limit the compression forces, tension forces, and/or torque forces that may exist between the smaller assembly 250 and the whipstock (not shown) when the two are coupled.

The smaller assembly 250, in the illustrated embodiment, may further include an associated lock ring profile 258. Accordingly, the lock ring profile 258, as well as the associated lock ring profile 228 and lock ring (not shown) of the larger bit assembly 220, may be used to linearly fix the larger bit assembly 220 and the smaller assembly 250, while the one or more external profiles 256, as well as the one or more internal profiles 226 of the larger bit assembly 220, may be used to rotationally fix the larger bit assembly 220 and the smaller assembly 250.

Figure 2E:
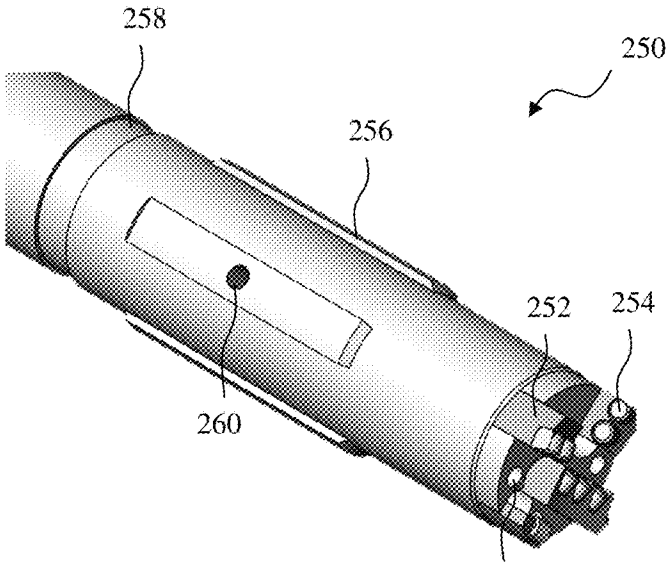

Turning now to FIG. 2E, illustrated is an isometric view of one embodiment of the smaller assembly 250 of FIG. 2A. In the illustrated embodiment of FIG. 2E, the smaller assembly 250 additionally includes one or more shear profiles 260, as well as one or more fluid ports 262. In at least one embodiment, the one or more shear profiles 260 house one or more shear features, the one or more shear features removably coupling the smaller assembly 250 to the whipstock assembly. In one embodiment, the one or more shear features are one or more shear pins and/or shear bolts. Nevertheless, other coupling mechanisms are within the scope of the present disclosure. The one or more fluid ports 262, in the illustrated embodiment, provide fluid access past (e.g., downhole of) the smaller assembly 250, to help cool the bit/mill, lubricate and remove cuttings.

Figure 3A:
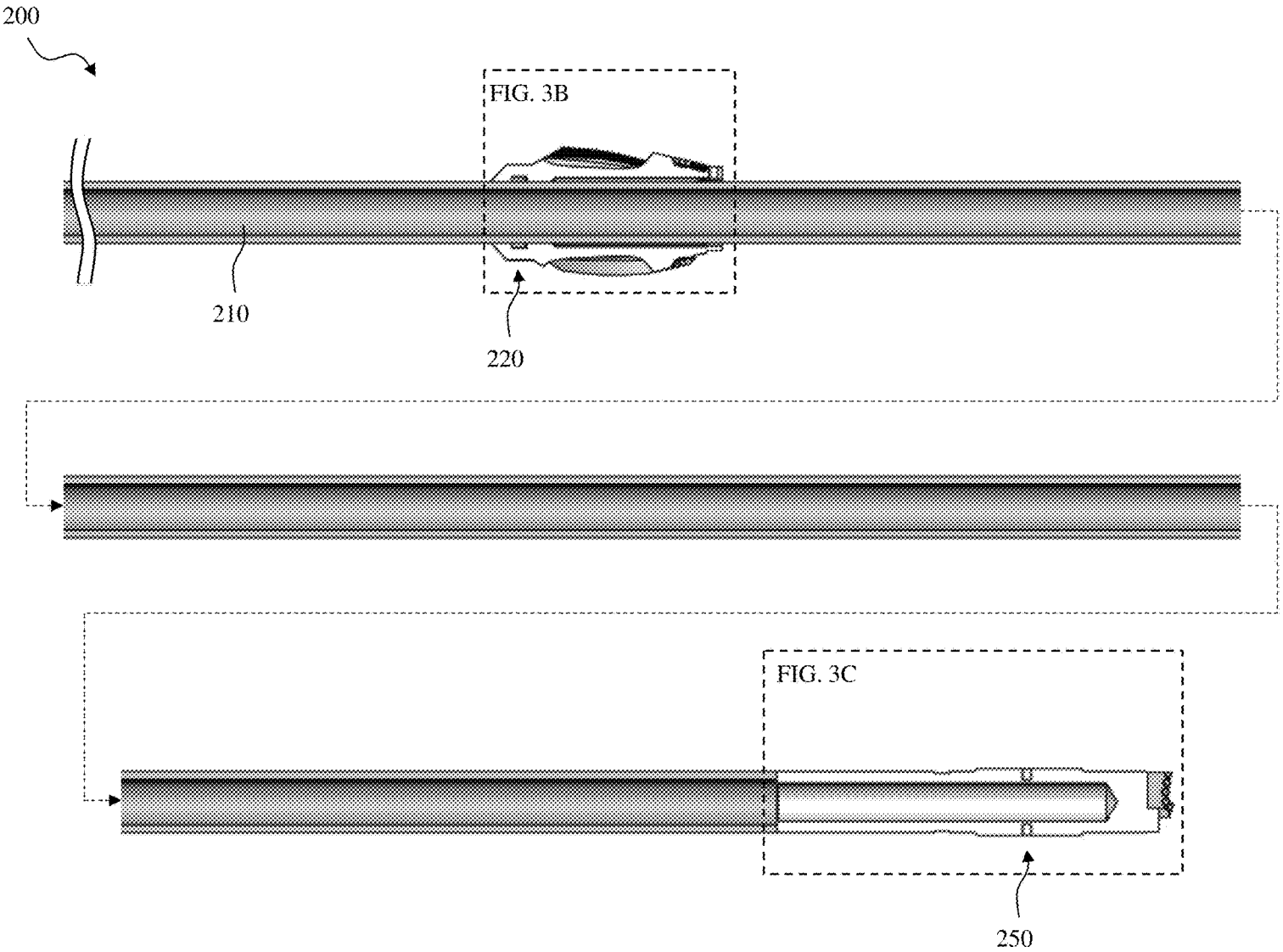
FIGS. 3A through 3C illustrate various different views of a two part milling and running tool designed, manufactured and operated according to one or more embodiments of the disclosure.

Turning to FIG. 3A, illustrated is a cross-sectional side view of the two part milling and running tool 200 of FIG. 2A.

Figure 3B:
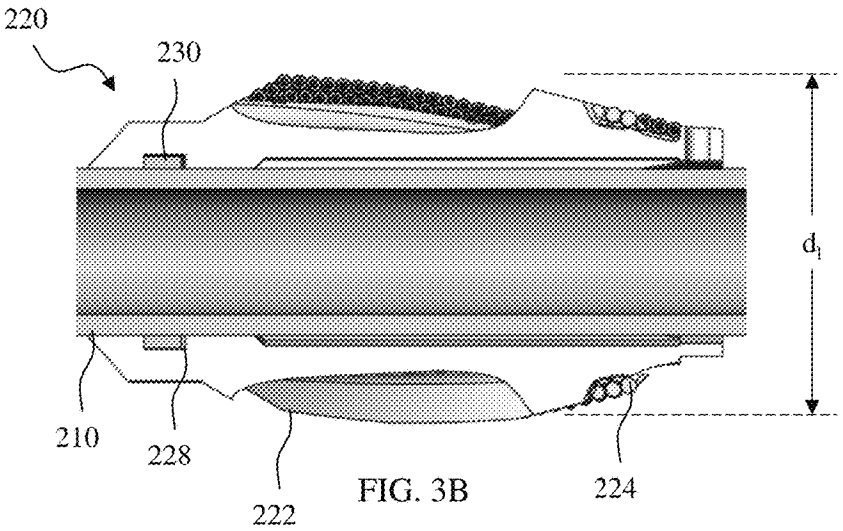

Turning now to FIG. 3B, illustrated is an enlarged side view of the larger bit assembly 220 of FIG. 3A. As can be shown in FIG. 3B, a lock ring 230 may be positioned within the lock ring profile 228, and surrounding the conveyance 210. As the conveyance 210 does not have a corresponding lock ring profile in the embodiment shown, the larger bit assembly 220 is allowed to slide along the conveyance 210 freely.

Figure 3C:
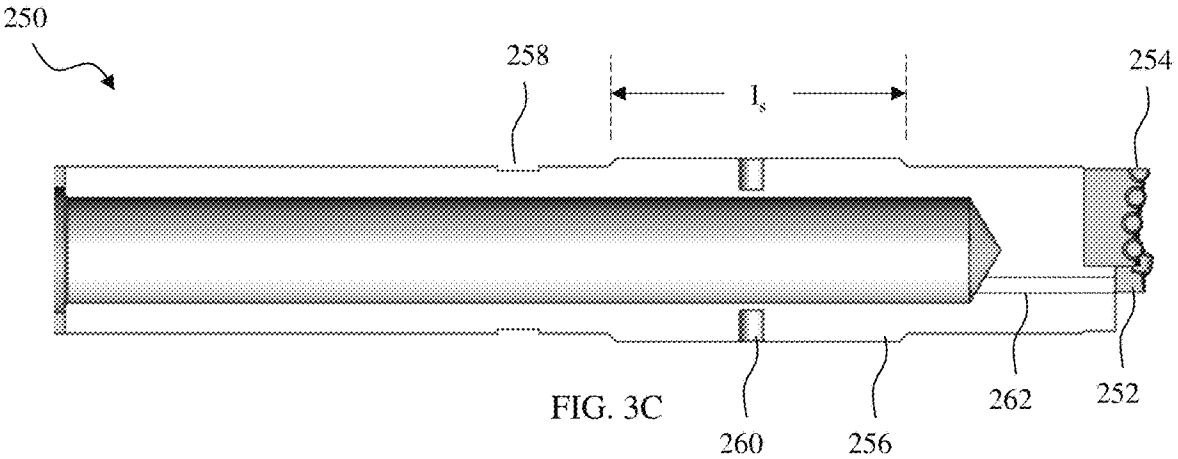

Turning now to FIG. 3C, illustrated is an enlarged side view of the smaller assembly 250 of FIG. 3A.

Figure 4:
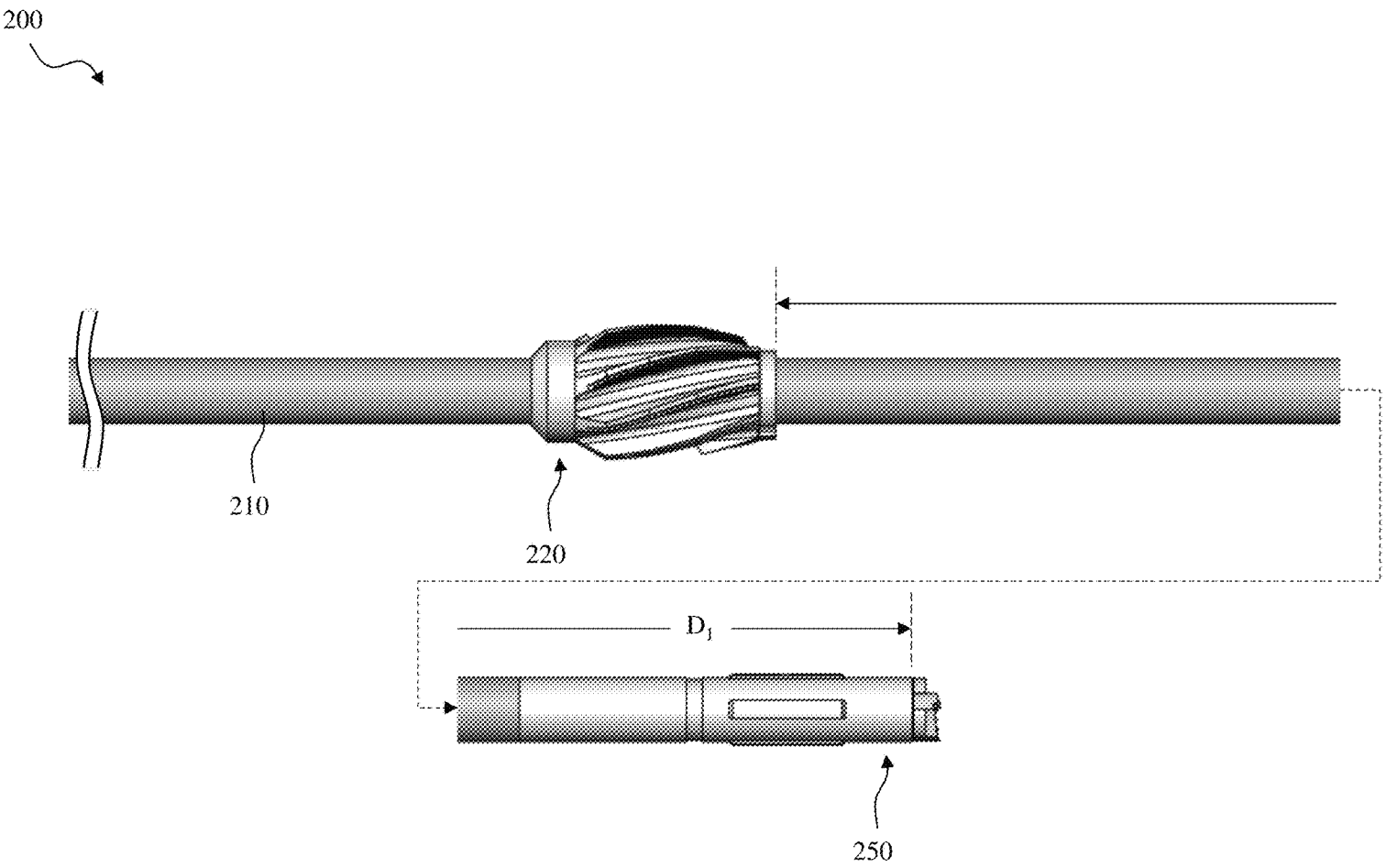
FIGS. 4 and 5 illustrate various different views of a two part milling and running tool designed, manufactured and operated according to one or more embodiments of the disclosure.

Turning to FIG. 4, illustrated is a side view of a two part milling and running tool 200 of FIGS. 2A and 3A, after the conveyance 210 has been pulled partially uphole, thereby sliding the smaller assembly 250 toward the larger bit assembly 220. In the illustrated embodiment, it is assumed that the larger bit assembly 220 is fixed in location, and that the smaller assembly 220 is sliding toward the fixed larger bit assembly 220. Such would be the case if the larger bit assembly 220 were still fixed (e.g., via friction, a shear feature, etc.) relative to the whipstock. In this partially slid position, the larger bit assembly 220 would be spaced apart from the smaller assembly 250 by a distance ($D_1$). In at least one embodiment, the distance ($D_1$) is at least 50 percent less than the distance ($D_0$).

Figure 5:
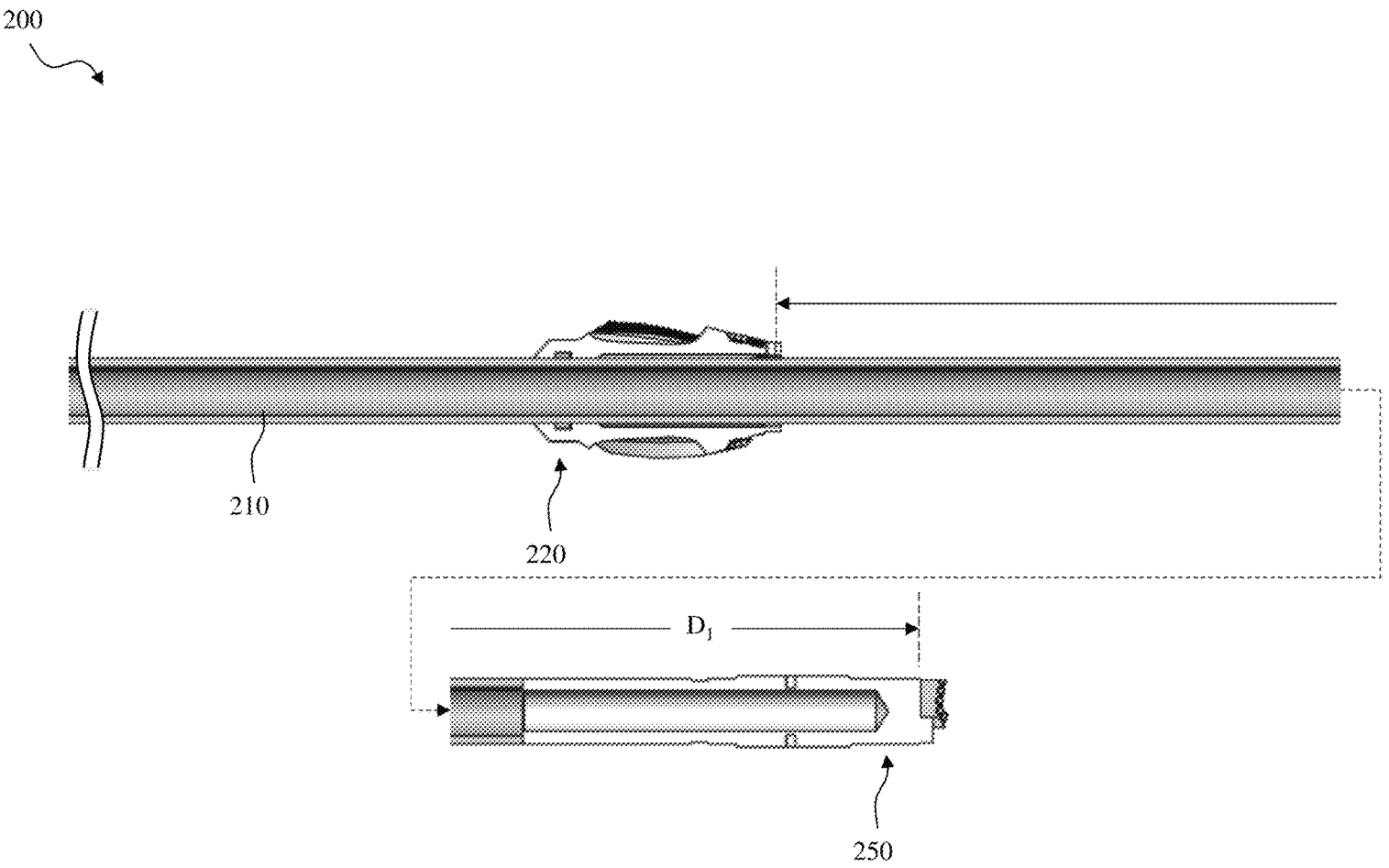

Turning to FIG. 5, illustrated is a cross-sectional side view of the two part milling and running tool 200 of FIG. 4.

Figure 6A:
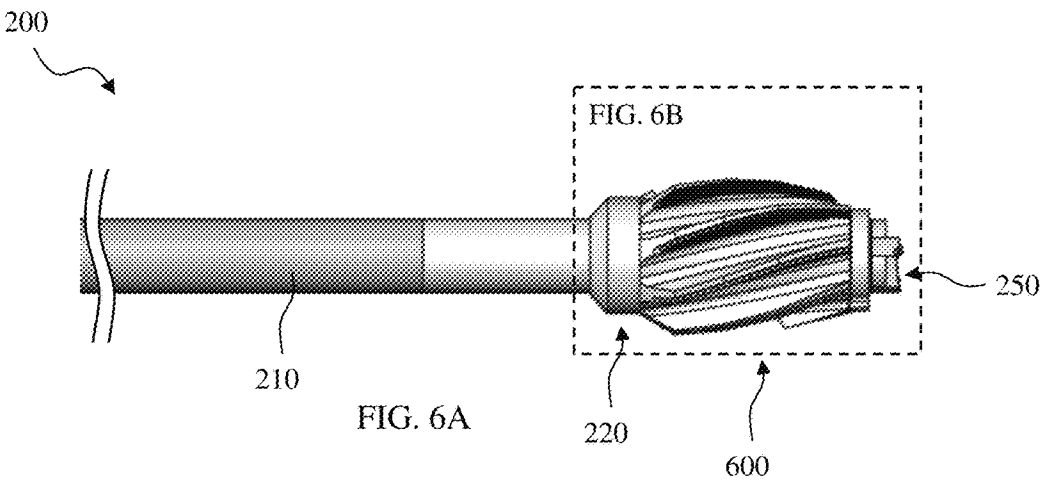
FIGS. 6A through 6C illustrate various different views of a two part milling and running tool designed, manufactured and operated according to one or more embodiments of the disclosure.

Turning to FIG. 6A, illustrated is a side view of a two part milling and running tool 200 of FIGS. 4 and 5, after the conveyance 210 has been pulled fully uphole, thereby sliding the smaller assembly 250 into engagement with the larger bit assembly 220, and thus forming a combined bit assembly 600.

Figure 6B:
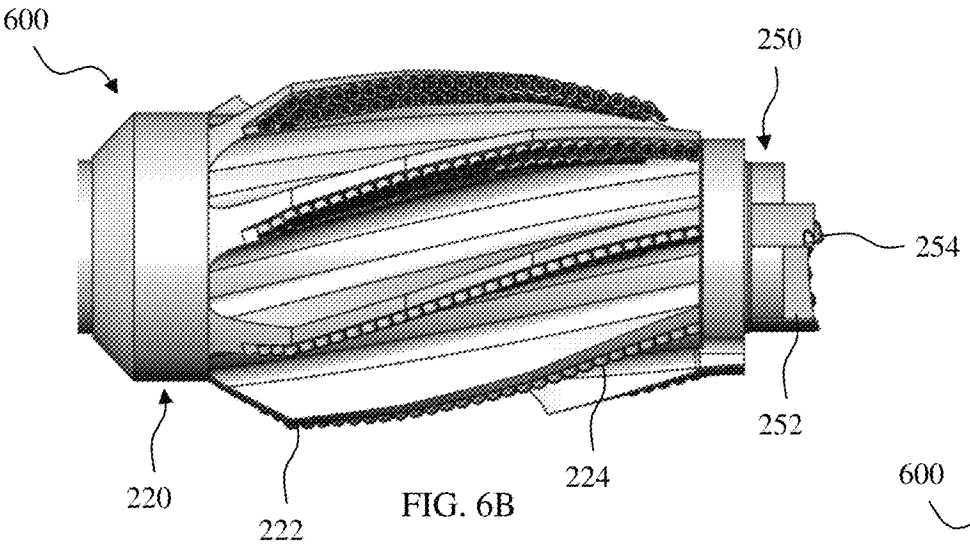

Turning now to FIG. 6B, illustrated is an enlarged side view of the combined bit assembly 600 of FIG. 6A. As shown, the smaller assembly 250 is engaged with the larger bit assembly 220. Furthermore, with the smaller assembly 250 engaged with the larger bit assembly 220, the combined bit assembly 600 may now approximate the shape of bit assemblies currently existing in the art.

Figure 6C:
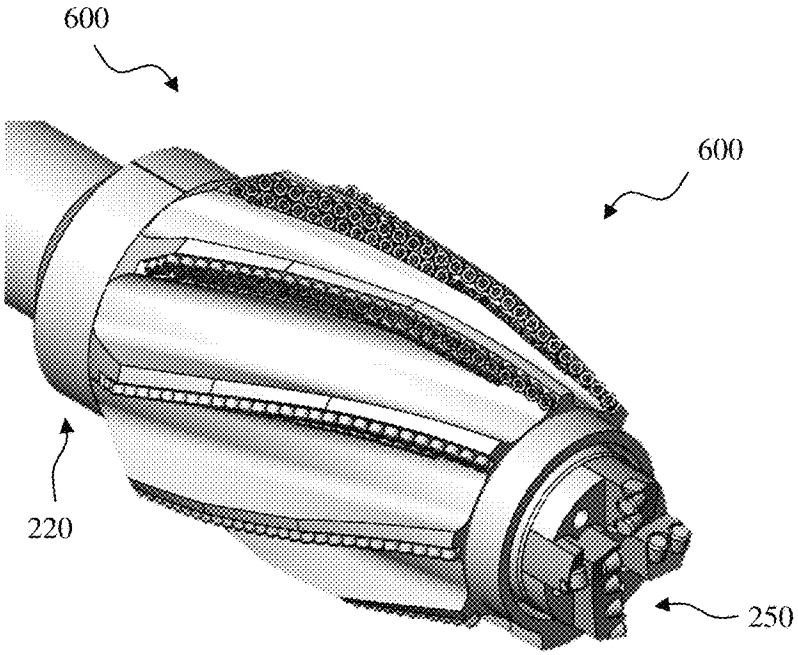

Turning now to FIG. 6C, illustrated is an isometric enlarged side view of the combined bit assembly 600 of FIG. 6A.

Figure 7A:
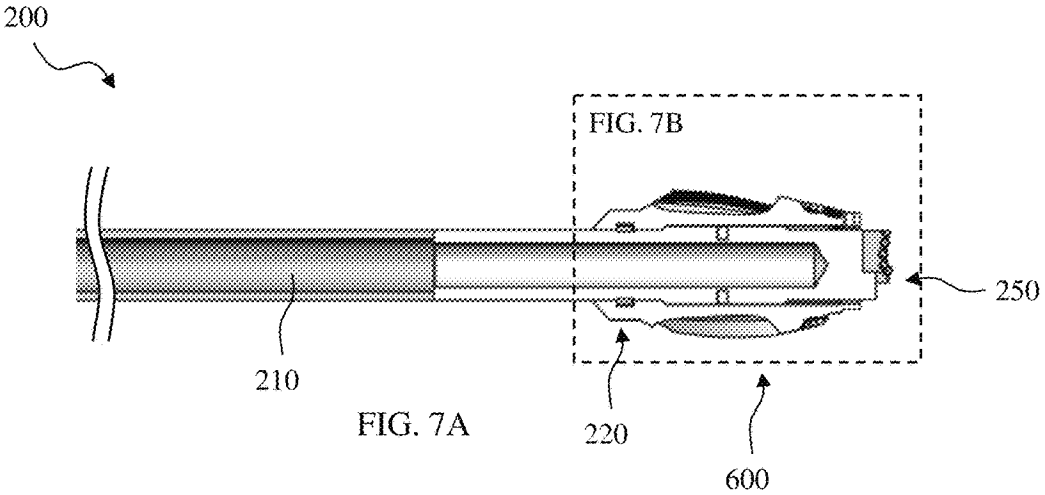
FIGS. 7A and 7B illustrate various different views of a two part milling and running tool designed, manufactured and operated according to one or more embodiments of the disclosure.

Turning to FIG. 7A, illustrated is a cross-sectional side view of a two part milling and running tool 200 of FIGS. 4 and 5, after the conveyance 210 has been pulled fully uphole, thereby sliding the smaller assembly 250 into engagement with the larger bit assembly 220, thereby forming the combined bit assembly 600.

Figure 7B:
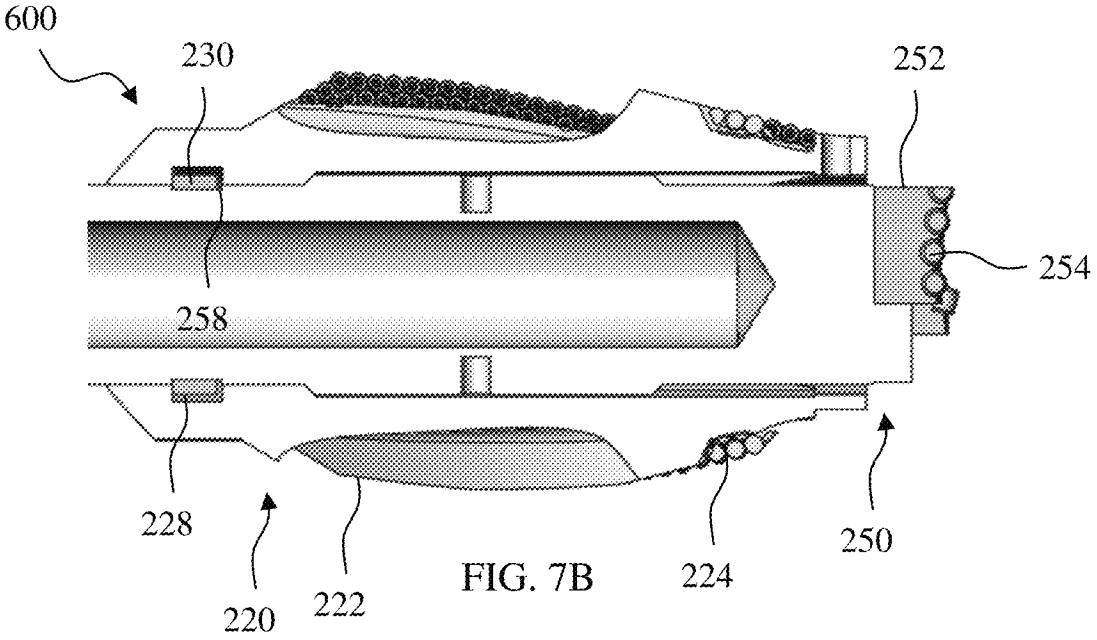

Turning now to FIG. 7B, illustrated is an enlarged cross-sectional side view of the combined bit assembly 600 of FIG. 7A. As shown in FIG. 7B, the lock ring 230 may snap into the associated lock ring profile 258 in the smaller assembly 250, and thus axially fix the smaller assembly 250 relative to the larger bit assembly 220.

Turning now to FIGS. 8A through 19, illustrated are different views of a well system 800, the well system 800 employing a two part drilling and running tool to form a lateral wellbore therein.

Figure 8A:
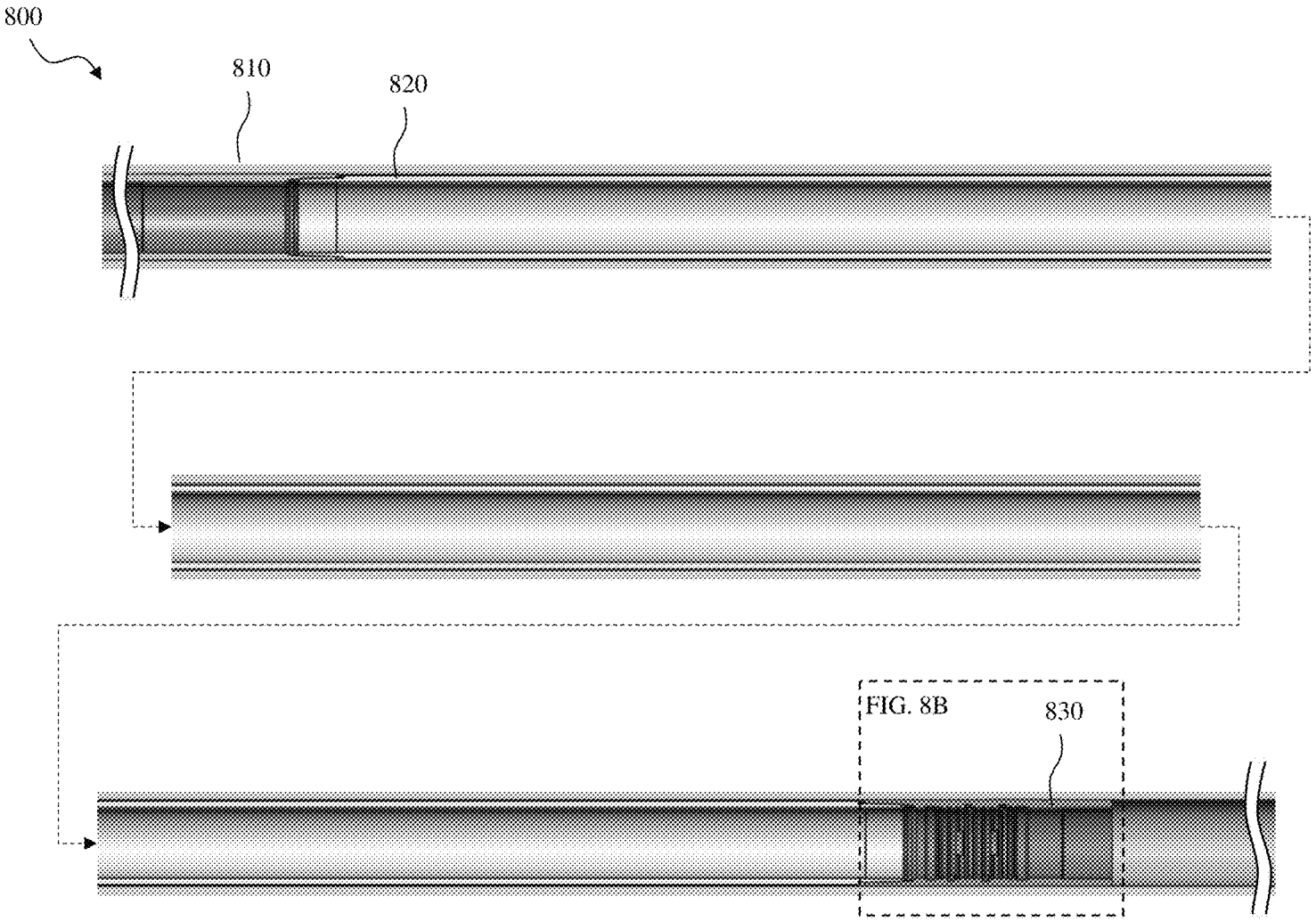
FIGS. 8A and 8B illustrate various different views of a well system, the well system employing a two part drilling and running tool, for example to form a lateral wellbore therein.

With initial reference to FIG. 8A, the well system 800 initially includes a main wellbore 810. As indicated above, the main wellbore 810 may be a primary wellbore extending from the surface, or a secondary wellbore already extending from a primary wellbore. Located in the main wellbore 810 is tubing string 820, such as casing string. In certain embodiment, while not shown, cement may be positioned between the main wellbore 810 and the tubing string 820.

In the illustrated embodiment, an anchoring assembly 830 is positioned in the tubing string 820 (e.g., in line with the tubing string 820). For example, in at least one embodiment, the anchoring assembly 830 is a latch coupling including one or more latch coupling profiles, the one or more latch coupling profiles configure to engage with one or more latch profiles of a downhole tool, such as a latch subassembly coupled to a whipstock.

Figure 8B:
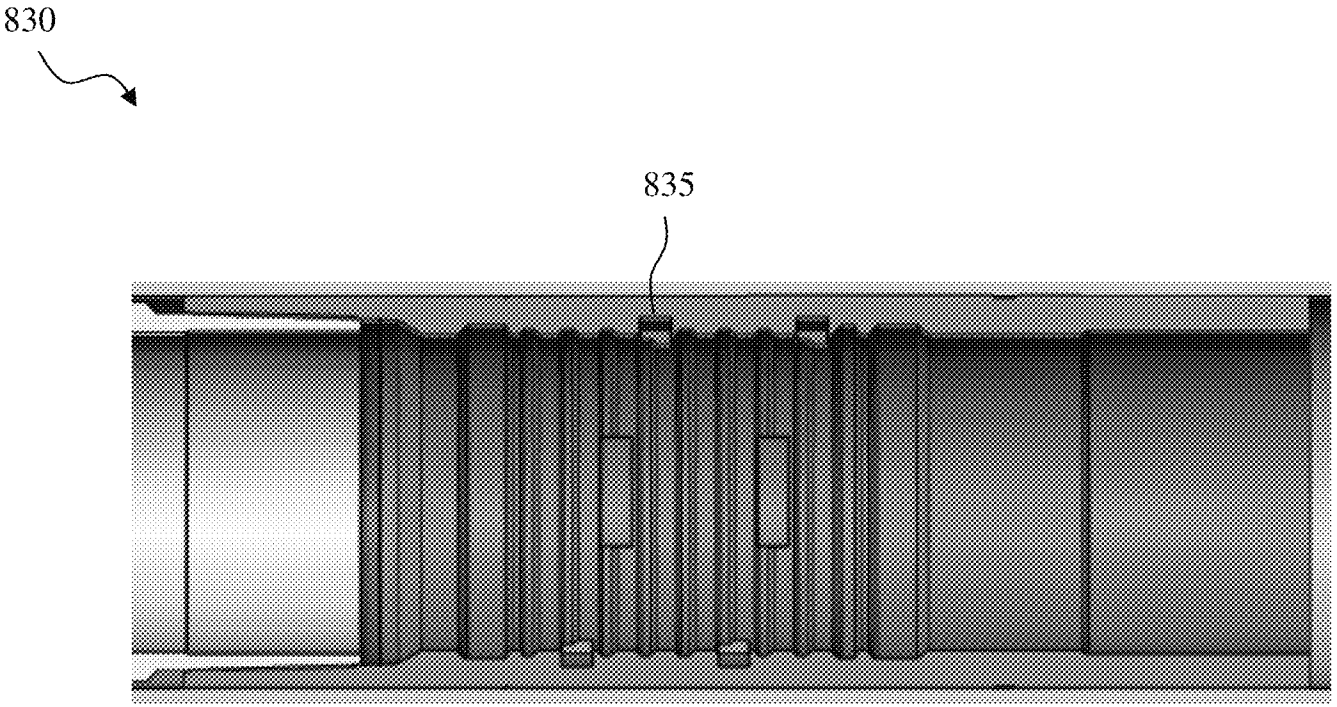

Turning now to FIG. 8B, illustrated is an enlarged side view of the anchoring assembly 830 of FIG. 8A. As shown, the anchoring assembly 830 may have the one or more latch coupling profiles 835.

Figure 9A:
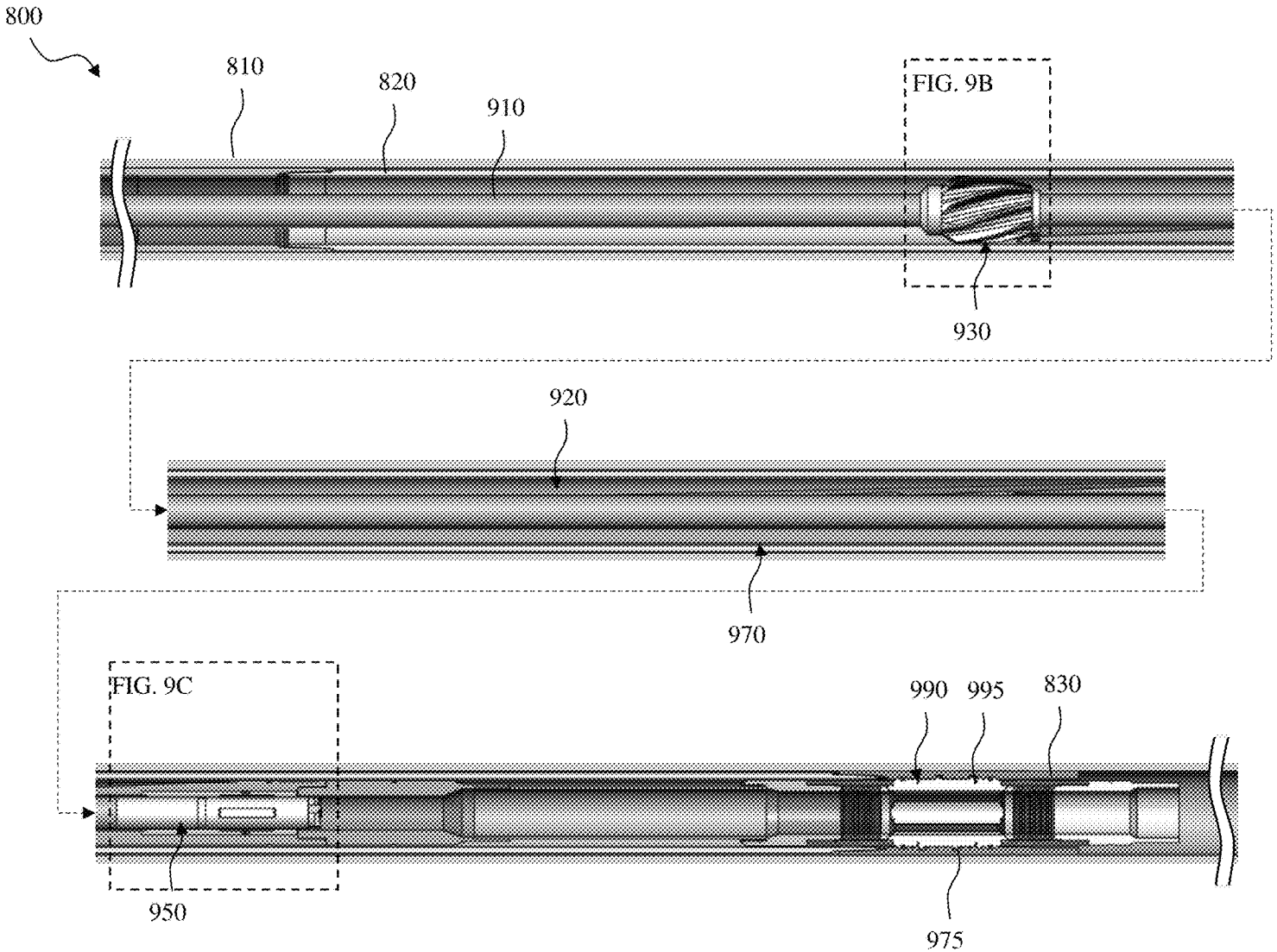
FIGS. 9A through 9D illustrate various different views of a well system, the well system employing a two part drilling and running tool, for example to form a lateral wellbore therein.

Turning now to FIG. 9A, illustrated is the well system 800 of FIG. 8A after employing a conveyance 910 and a two part drilling and running tool 920 to run a whipstock assembly 970 within the main wellbore 810, and ultimately couple the whipstock assembly 970 with the anchoring assembly 830. For example, in the illustrated embodiment, the whipstock assembly 970 is coupled to a latch subassembly 990 having one or more latches 995 associated therewith. In the illustrated embodiment, the one or more latches 995 of the latch subassembly 990 engage with the one or more latch coupling profiles 835 of the anchoring assembly 830 to secure the whipstock assembly 970 within the tubing string 820.

The two part drilling and running tool 920 may be similar to the two part drilling and running tool discussed above. Accordingly, the two part drilling and running tool 920 may include a larger bit assembly 930 and a smaller assembly 950. As shown in the embodiment of FIG. 9A, the smaller assembly 950 is coupled to a downhole end of the conveyance 910, and extends at least partially within a through bore of the whipstock assembly 970.

Figure 9B:
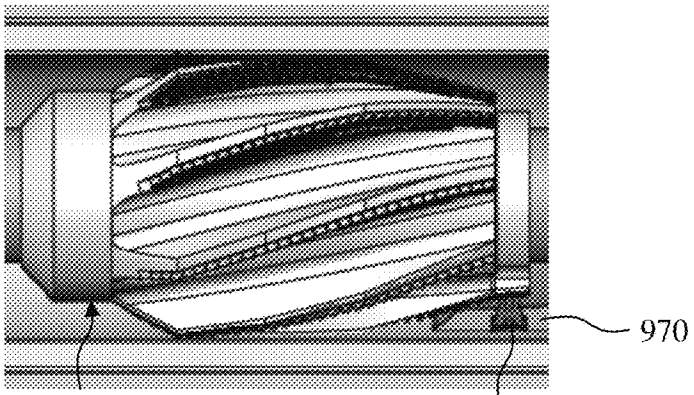

Turning now to FIG. 9B, illustrated is an enlarged side view of the larger bit assembly 930 of FIG. 9A. In the illustrated embodiment of FIG. 9B, the larger bit assembly 930 is coupled proximate an uphole end of the whipstock assembly 970. For example, a coupling mechanism 935 (e.g., shear feature) may be employed to couple the larger bit assembly 930 to the whipstock assembly 970. While a shear feature has been illustrated, other coupling mechanisms 935 could also be used. Moreover, as has been discussed above, the coupling mechanism 935 is not necessary in all embodiments.

Figure 9C:
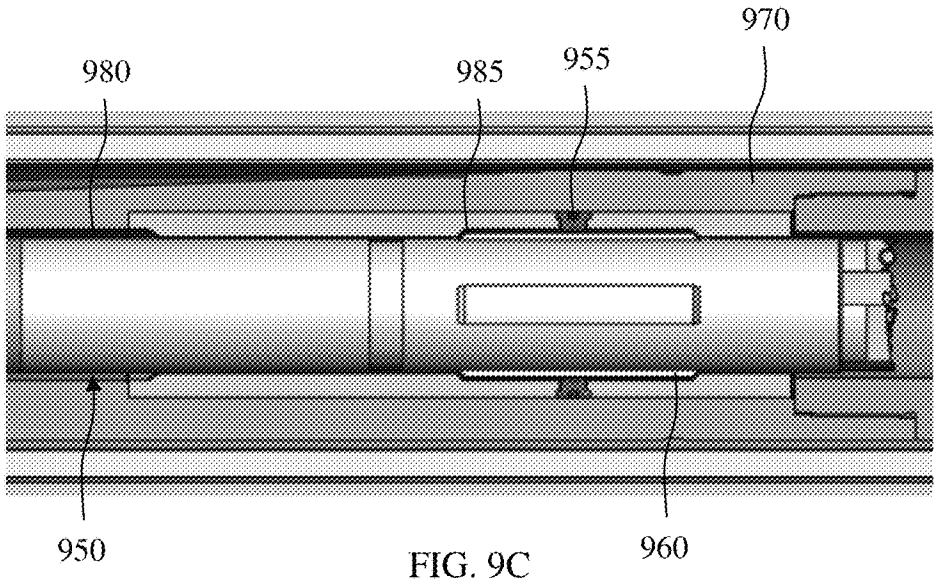

Turning now to FIG. 9C, illustrated is an enlarged side view of the smaller assembly 950 of FIG. 9A. In the illustrated embodiment of FIG. 9C, the smaller assembly 950 is coupled proximate a downhole end of the whipstock assembly 970. For example, a coupling mechanism 955 (e.g., shear feature) has been employed to couple the smaller assembly 950 to the whipstock assembly 970. While a shear feature has been illustrated, other coupling mechanisms 955 could also be used.

In at least one embodiment, the coupling mechanism 955 is coupled within a bottom 40 percent of the whipstock assembly 970. In yet another embodiment, the coupling mechanism 955 is coupled within a bottom 20 percent of the whipstock assembly 970. In even another embodiment, the coupling mechanism 955 is coupled within a bottom 10 percent, if not bottom 5 percent, of the whipstock assembly 970. The smaller assembly 950, in the illustrated embodiment, additionally extends within a through bore 980 of the whipstock assembly 970.

As indicated above, the smaller assembly 950 may have one or more external profiles 960 that engage with one or more internal profiles 985 of the whipstock assembly 970. Accordingly, a combination of the coupling mechanism 955, the one or more external profiles 960, and the one or more internal profiles 985, may isolate the force (e.g., to only one of tension, compression or torsion) required to shear the coupling mechanism 955.

Figure 9D:
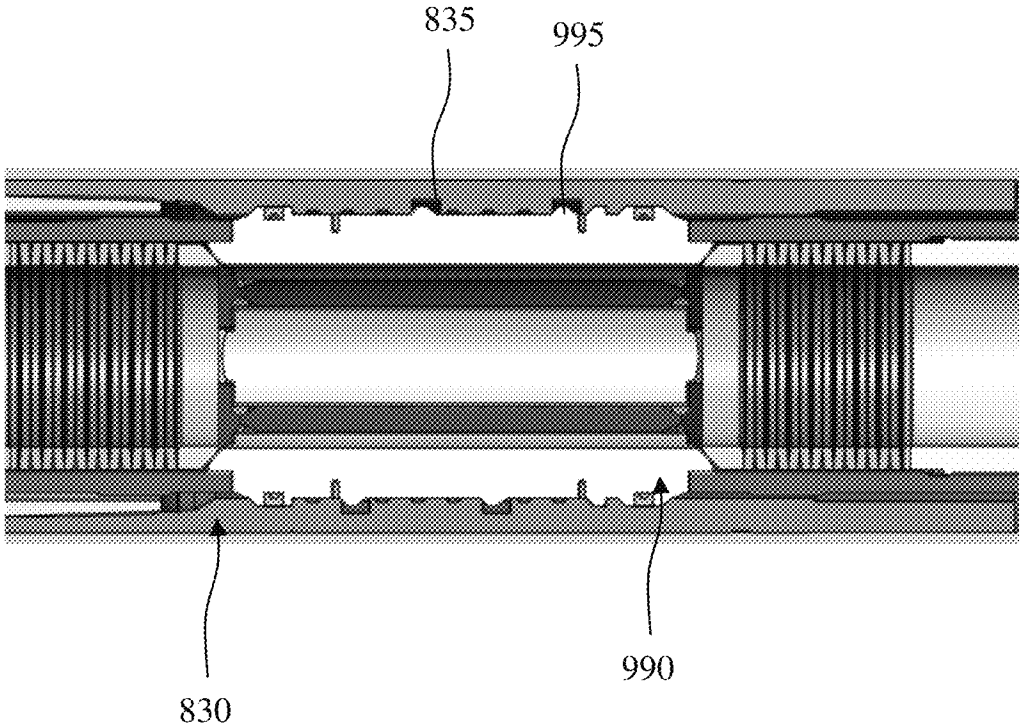

Turning now to FIG. 9D, illustrated is an enlarged side view of the latch subassembly 990 engaged with the anchoring assembly 830. For example, as illustrated, the one or more latches 995 of the latch subassembly 990 are engaged with the one or more latch coupling profiles 835 of the anchoring assembly 830.

Figure 10A:
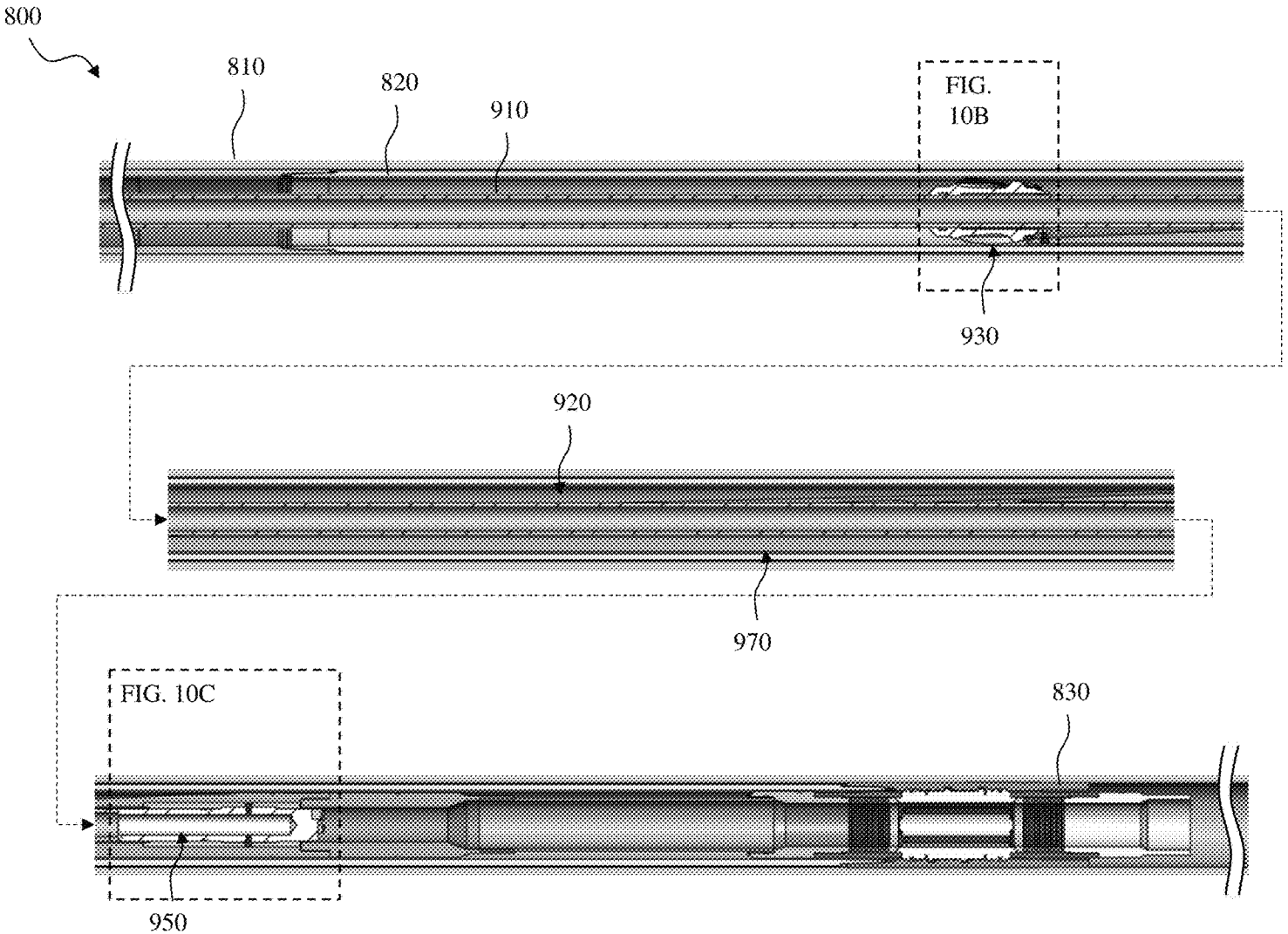
FIGS. 10A through 10C illustrate various different views of a well system, the well system employing a two part drilling and running tool, for example to form a lateral wellbore therein.

Turning to FIG. 10A, illustrated is a cross-sectional side view of the well system 800 of FIG. 9A.

Figure 10C:
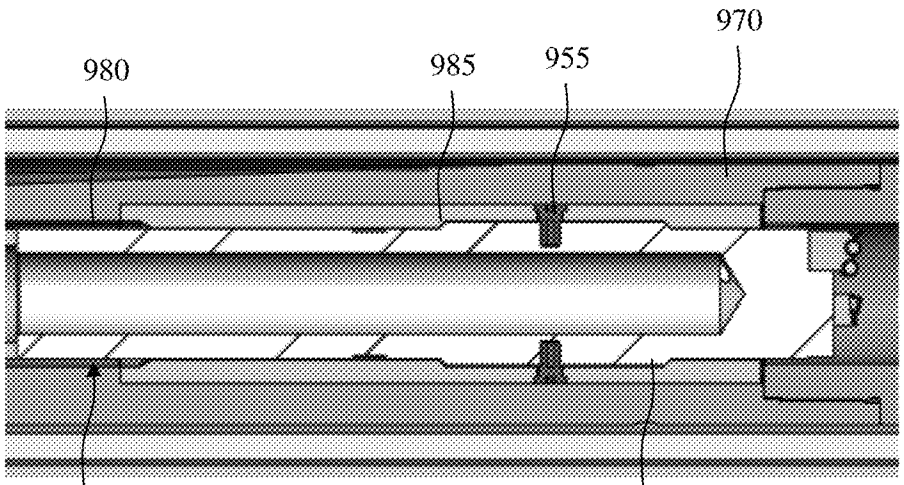
Figure 10B:
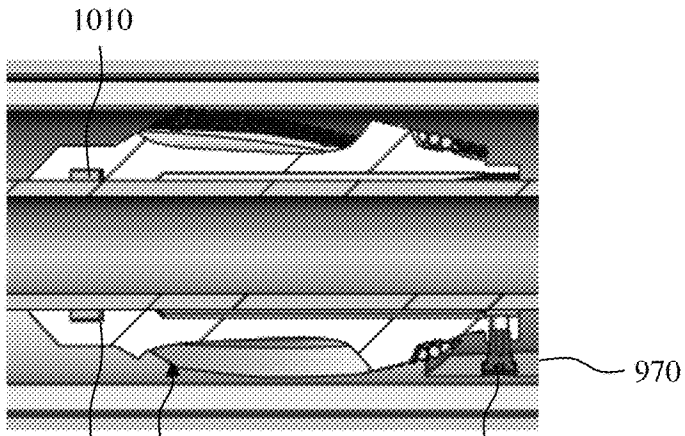

Turning now to FIG. 10B, illustrated is an enlarged cross-sectional side view of the larger bit assembly 930 of FIG. 10A. As can be seen in FIG. 10B, a lock ring 1010 may be positioned within a lock ring profile 1020 in the larger bit assembly 930. As the conveyance 910 does not have a corresponding lock ring profile in the embodiment shown, but for the coupling mechanism 935, the larger bit assembly 930 would be allowed to slide along the conveyance 910 freely. Nevertheless, the coupling mechanism 935 is preventing the larger bit assembly 930 from moving in the embodiment of FIG. 10B.

Turning now to FIG. 10C, illustrated is an enlarged cross-sectional side view of the smaller assembly 950 of FIG. 10A.

Figure 11A:
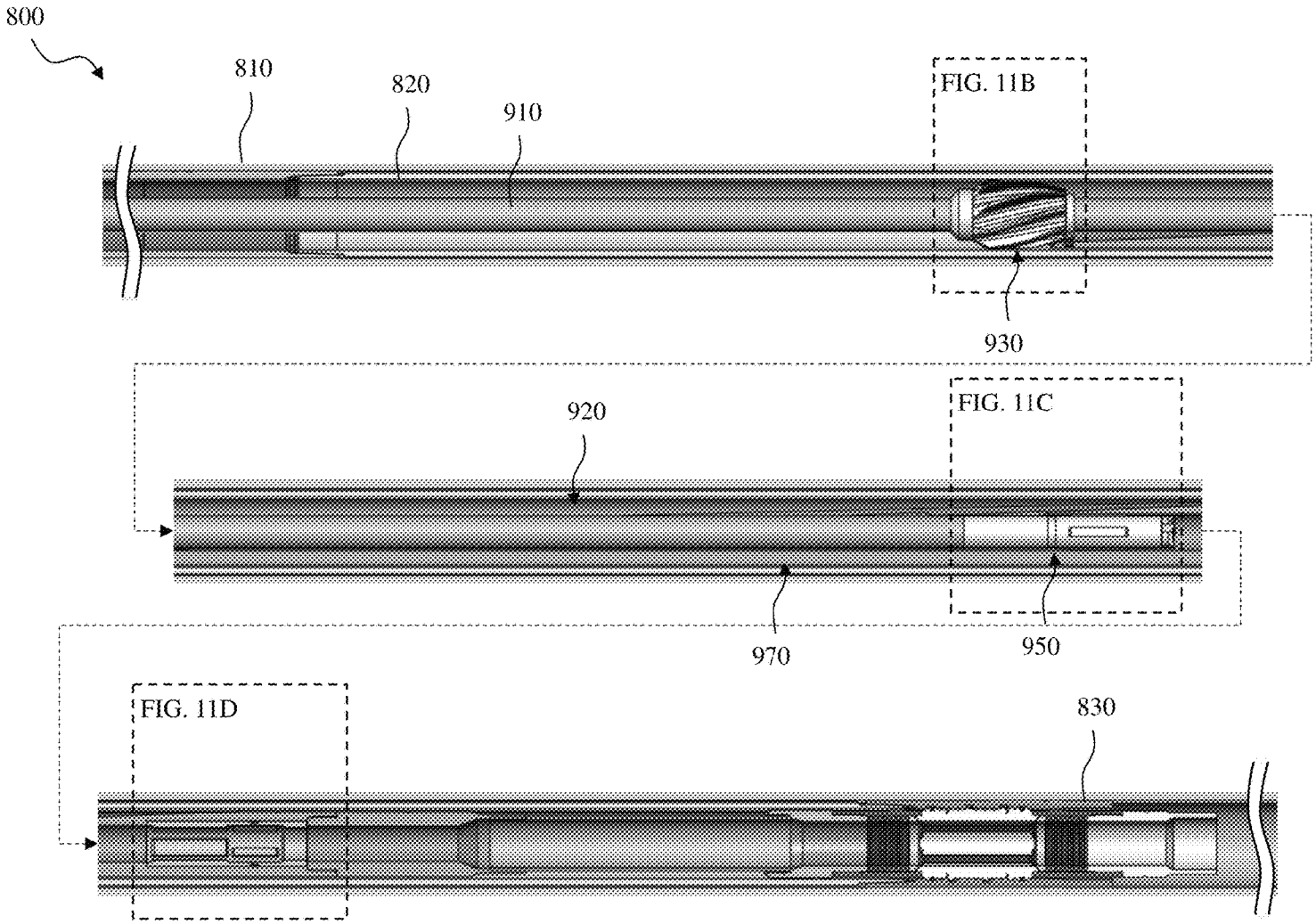
FIGS. 11A through 11D illustrate various different views of a well system, the well system employing a two part drilling and running tool, for example to form a lateral wellbore therein.

Turning now to FIG. 11A, illustrated is the well system 800 of FIG. 10A after generating enough force with the conveyance 910 to shear the coupling mechanism 955 fixing the smaller assembly 950 to the whipstock assembly 970. Again, in at least one embodiment and depending on the design, only a single type of force (e.g., tension, compression, torsion) would (or even could) shear the coupling mechanism 955. In the illustrated embodiment, the force required to shear the coupling mechanism is torsional force, but in other designs it could be either tension force or compression force.

In the illustrated embodiment, the coupling mechanism 955 has sheared due to the torsion force, and the smaller assembly 950 has subsequently been withdrawn a small distance uphole. Given the sliding relationship between the smaller assembly 950 and the larger bit assembly 930, and the fact that the larger bit assembly 930 is fixed relative to the whipstock assembly 970, the conveyance 910 slides within an inside diameter of the larger bit assembly 930.

As shown, the conveyance 910 has been pulled uphole, thereby sliding the smaller assembly 950 into engagement with the larger bit assembly 930, and thus forming a combined bit assembly 1110.

Figure 11B:
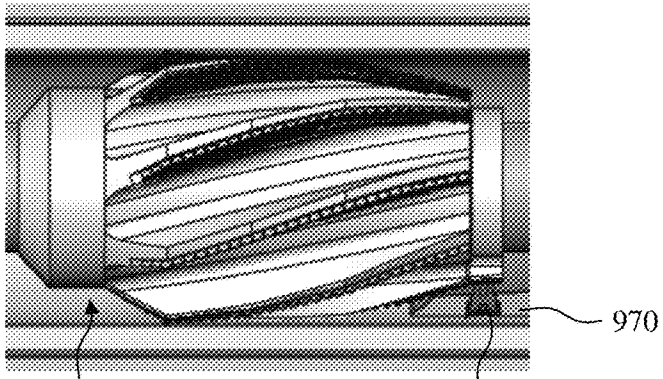

Turning now to FIG. 11B, illustrated is an enlarged side view of the combined bit assembly 1110 of FIG. 11A. As shown, the smaller assembly 950 is engaged with the larger bit assembly 930. Furthermore, with the smaller assembly 950 engaged with the larger bit assembly 930, the combined bit assembly 1110 may now approximate the shape of bit assemblies currently existing in the art.

Figure 11D:
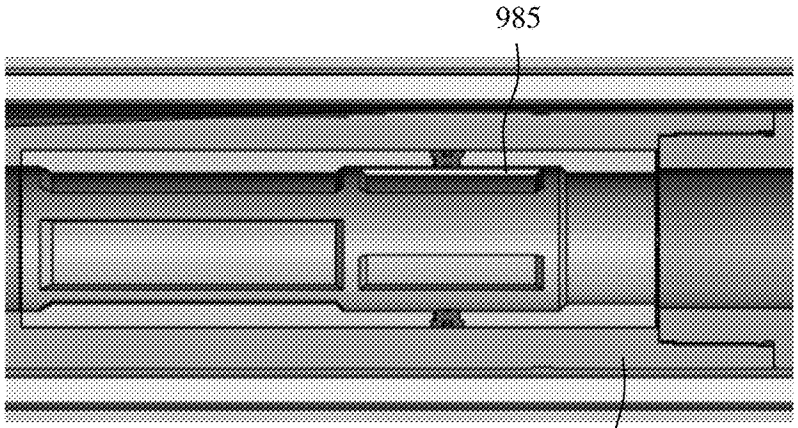
Figure 11C:
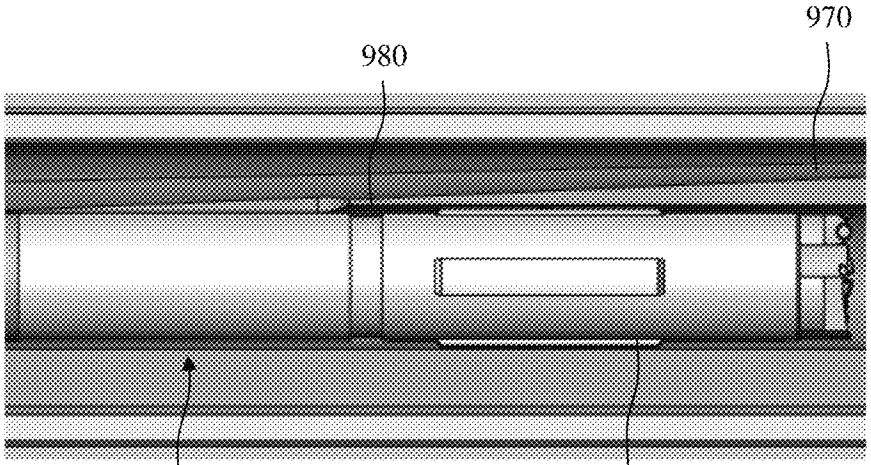

Turning now to FIG. 11C, illustrated is an enlarged side view of the whipstock assembly 970. As shown, the whipstock assembly 970 has the one or more internal profiles 985 that were previously engaged with the one or more external profiles 960 of the smaller assembly 950.

Turning now to FIG. 11D, illustrated is an enlarged side view of the whipstock assembly 970. As shown, the whipstock assembly 970 has the one or more internal profiles 985 that were previously engaged with the one or more external profiles 960 of the smaller assembly 950.

Figure 12A:
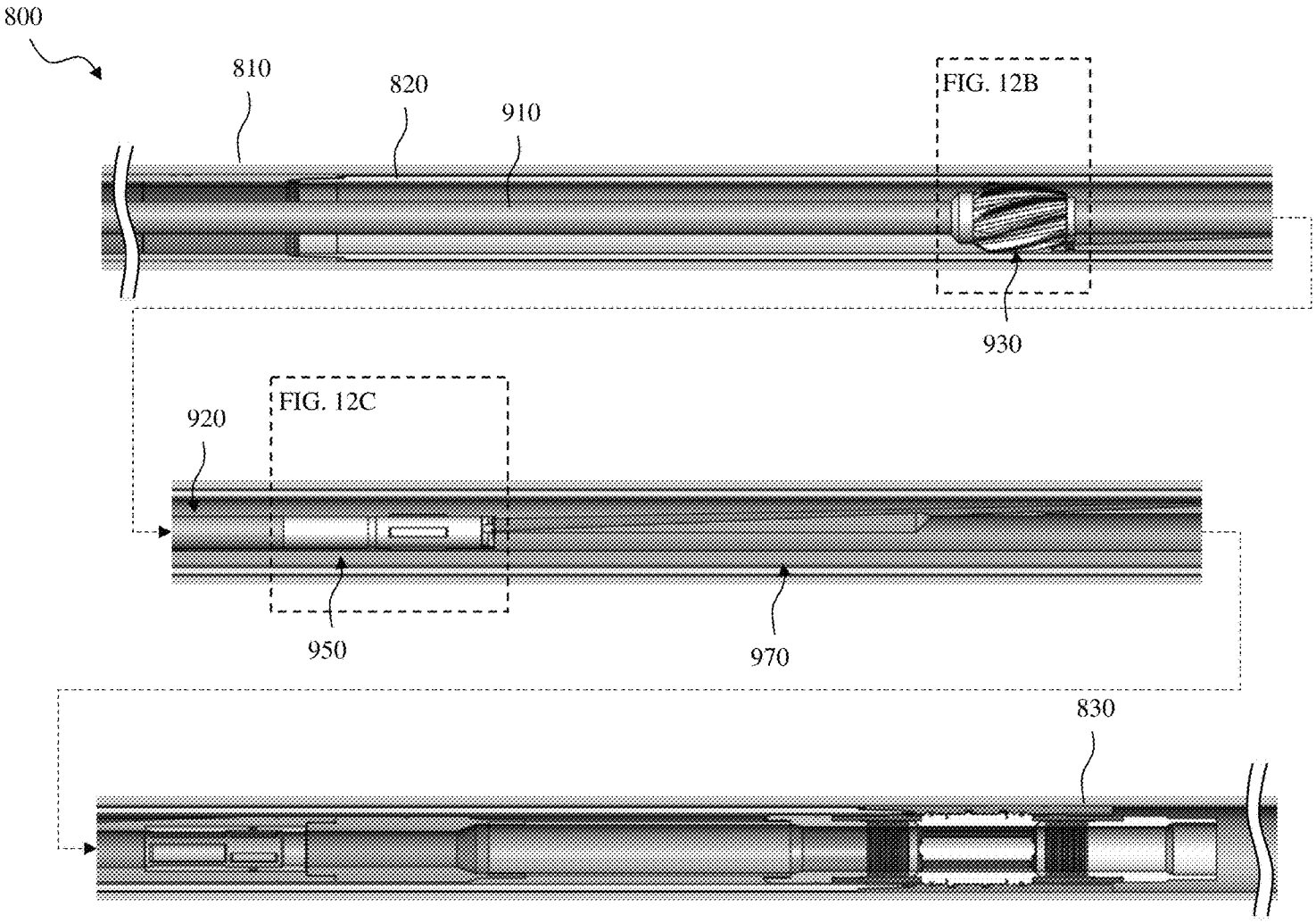
FIGS. 12A through 12C illustrate various different views of a well system, the well system employing a two part drilling and running tool, for example to form a lateral wellbore therein.

Turning now to FIG. 12A, illustrated is the well system 800 of FIG. 11A after continuing to withdraw the conveyance 910 and the smaller assembly 950 uphole.

Figure 12C:
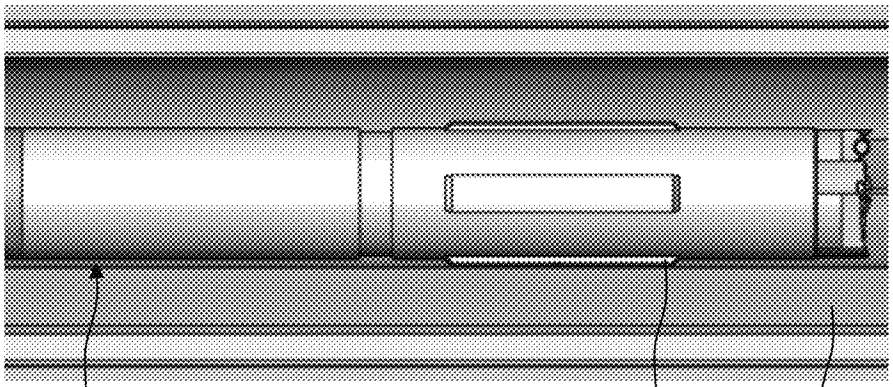
Figure 12B:
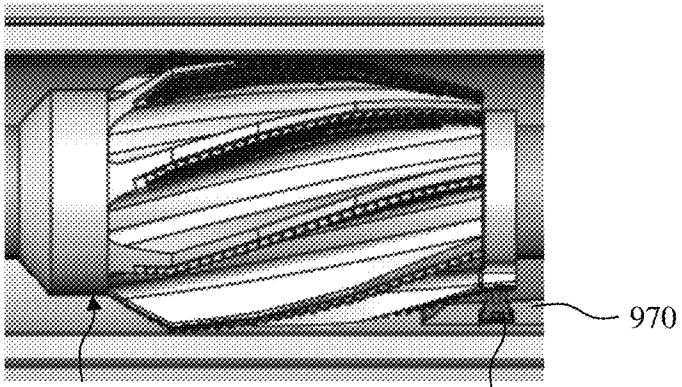

Turning now to FIG. 12B, illustrated is an enlarged side view of the larger bit assembly 930 of FIG. 12A. The larger bit assembly 930 of FIG. 12A is in substantially the same position as it was located in FIGS. 10A and 11A.

Turning now to FIG. 12C, illustrated is an enlarged side view of the smaller assembly 950 of FIG. 12A. In the illustrated embodiment of FIG. 12C, the smaller assembly 950 has fully exited the through bore 980 of the whipstock assembly 970, and continues to slide along a lower surface of the whipstock assembly 970.

Figure 13A:
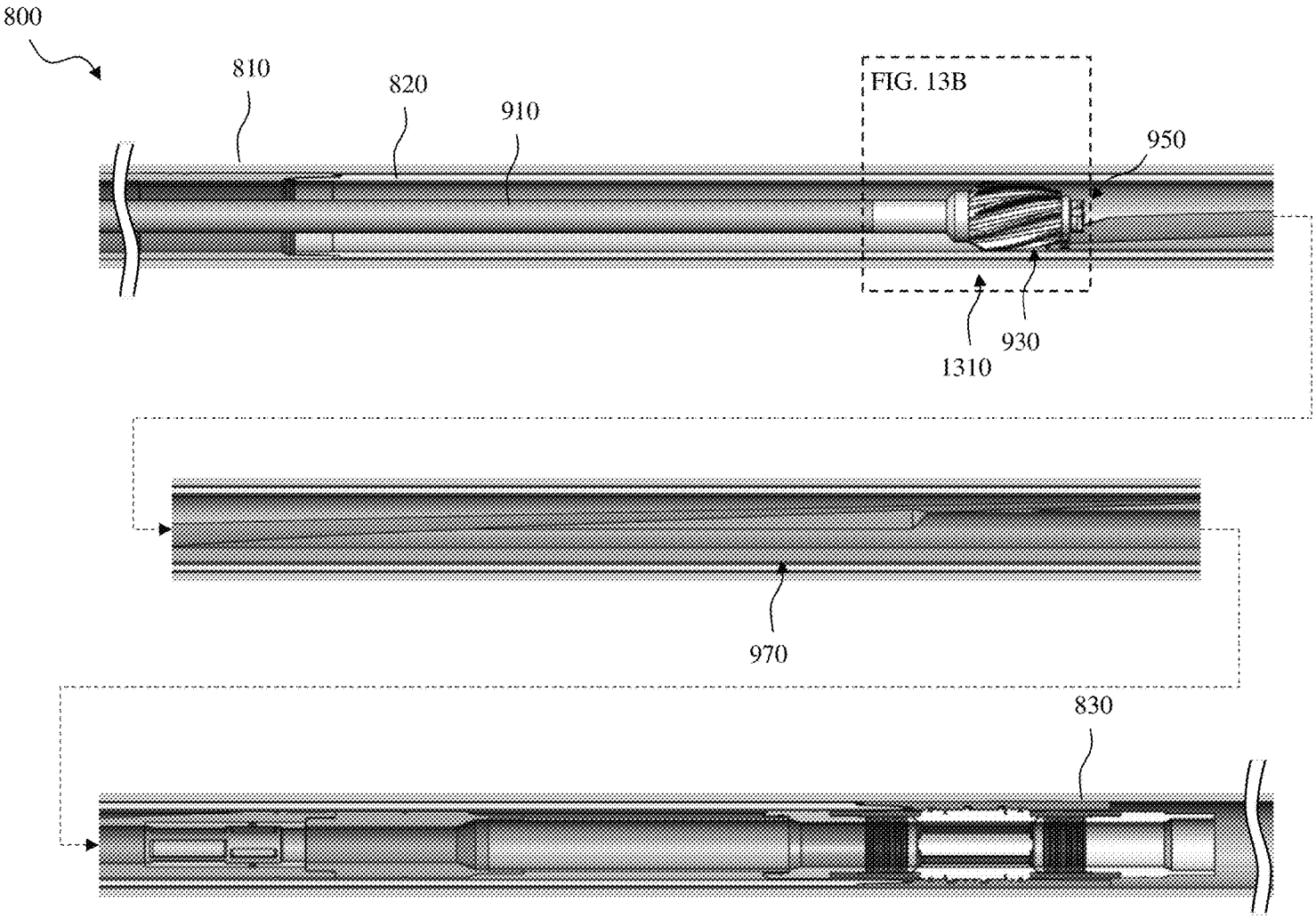
FIGS. 13A and 13B illustrate various different views of a well system, the well system employing a two part drilling and running tool, for example to form a lateral wellbore therein.

Turning to FIG. 13A, illustrated is a side view of a well system 800 of FIG. 12A, after the conveyance 910 has been pulled uphole, thereby sliding the smaller assembly 950 into engagement with the larger bit assembly 930, and thus forming a combined bit assembly 1310.

Figure 13B:
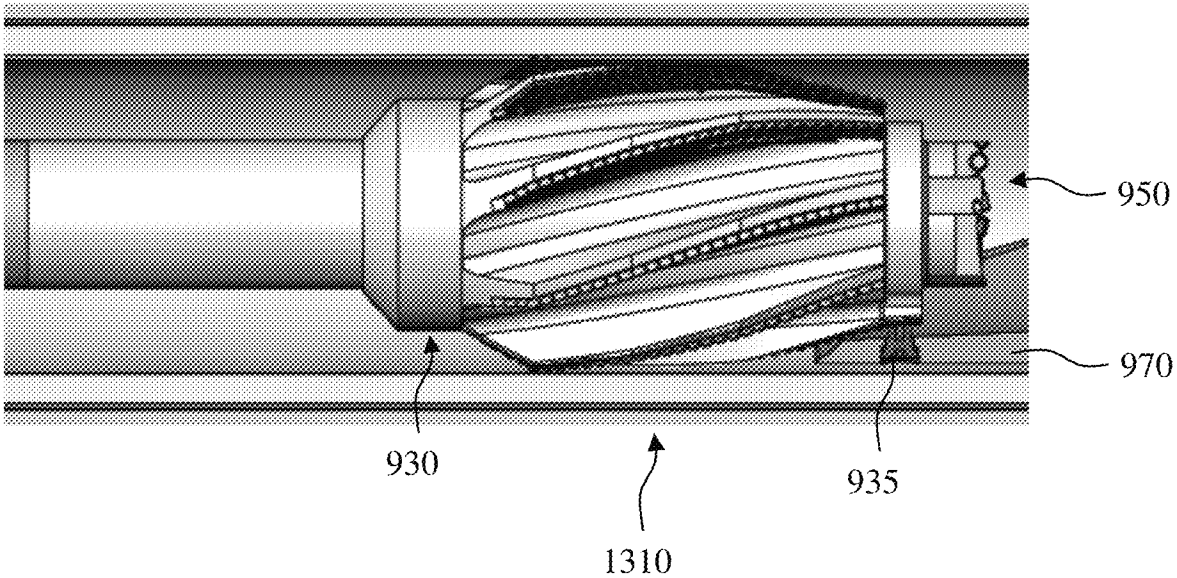

Turning now to FIG. 13B, illustrated is an enlarged side view of the combined bit assembly 1310 of FIG. 13A. As shown, the smaller assembly 950 is engaged with the larger bit assembly 930. Furthermore, with the smaller assembly 950 engaged with the larger bit assembly 930, the combined bit assembly 1310 may now approximate the shape of bit assemblies currently existing in the art.

Figure 14A:
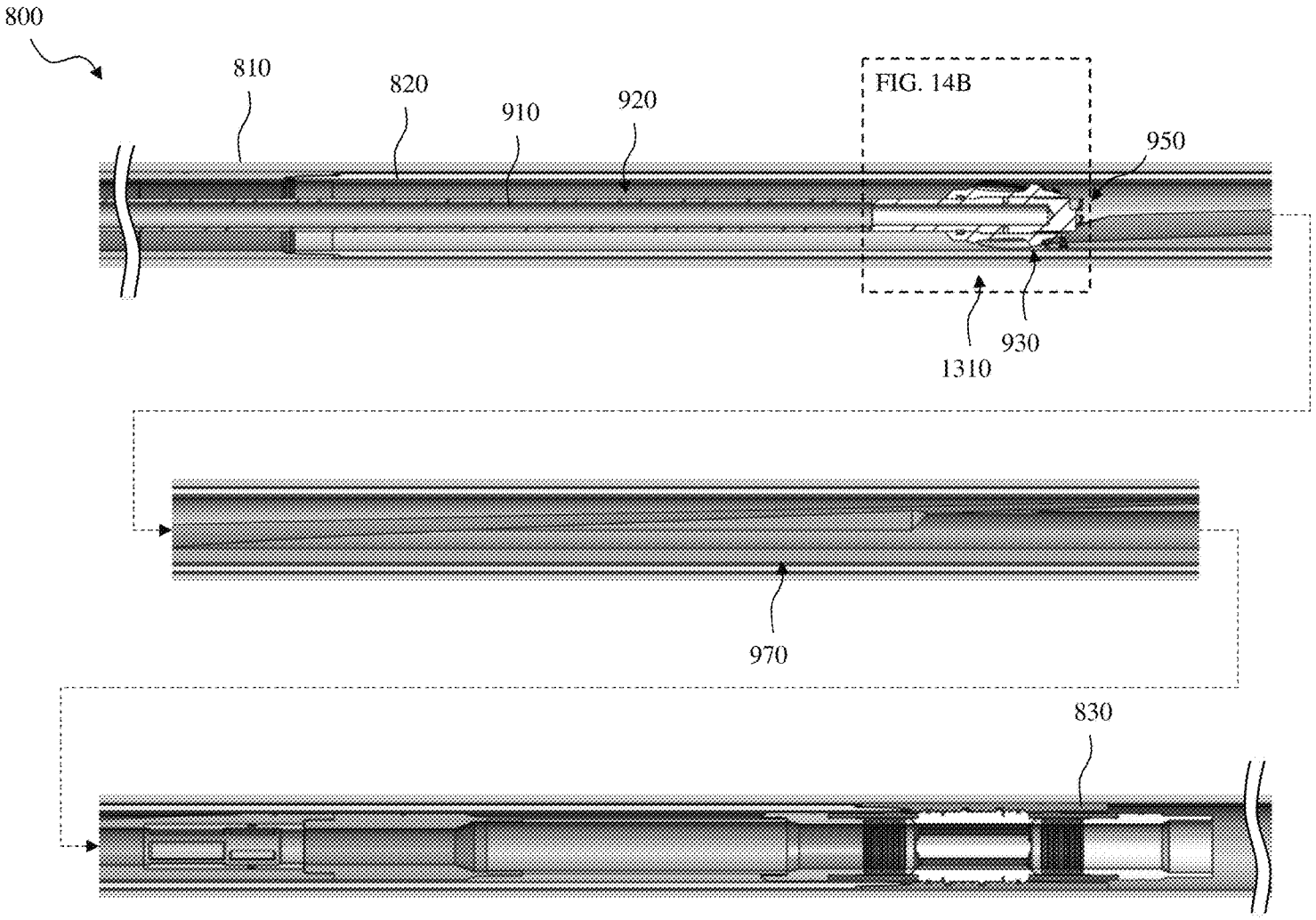
FIGS. 14A and 14B illustrate various different views of a well system, the well system employing a two part drilling and running tool, for example to form a lateral wellbore therein.

Turning to FIG. 14A, illustrated is a cross-sectional side view of the well system 800 of FIG. 13A.

Figure 14B:
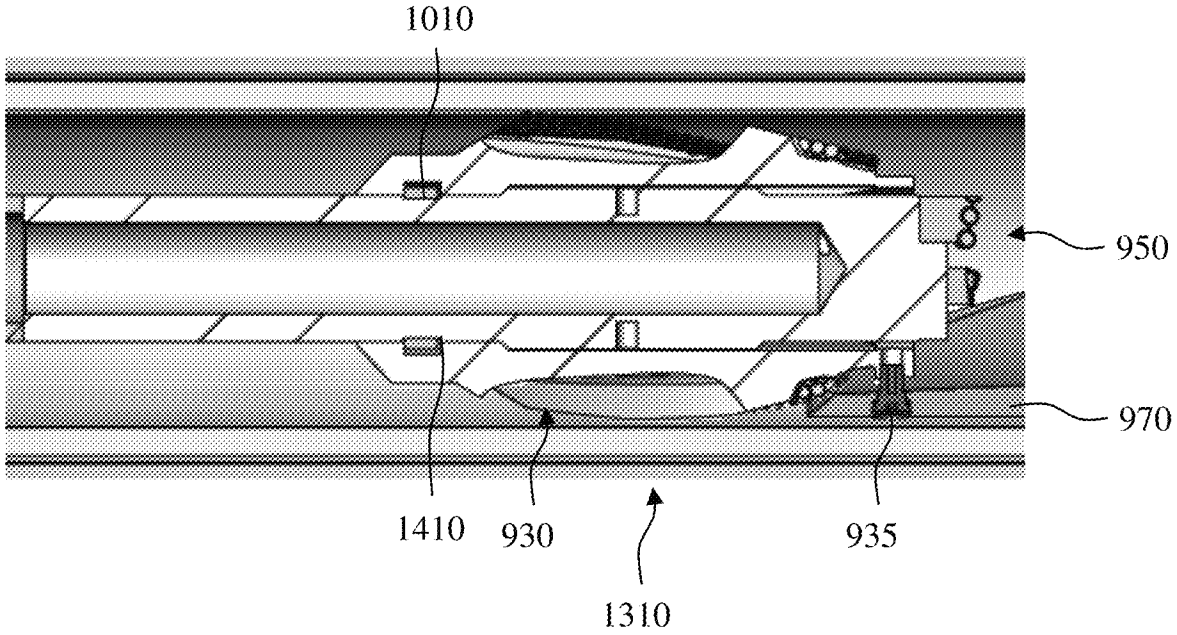

Turning now to FIG. 14B, illustrated is an enlarged cross-sectional side view of the combined bit assembly 1310 of FIG. 14A. As shown in FIG. 14B, the lock ring 1010 may snap into the associated lock ring profile 1410 in the smaller assembly 950, and thus axially fix the smaller assembly 950 relative to the larger bit assembly 930. As discussed above, the one or more external profiles 960 in the smaller assembly 950 may engage with the one or more internal profiles of the larger bit assembly 930 to rotationally fix the smaller assembly 950 relative to the larger bit assembly 930.

Figure 15A:
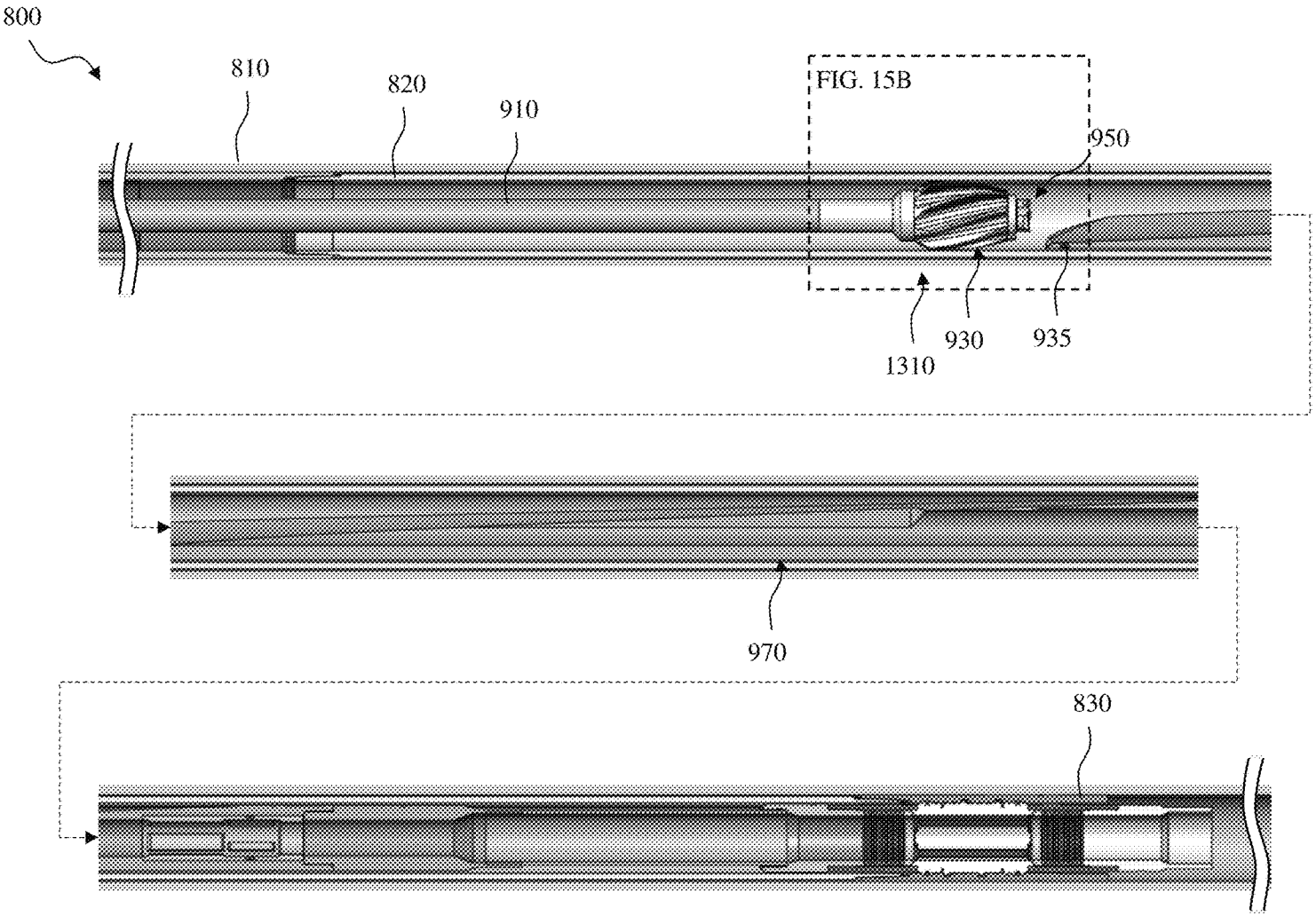
FIGS. 15A and 15B illustrate various different views of a well system, the well system employing a two part drilling and running tool, for example to form a lateral wellbore therein.

Turning to FIG. 15A, illustrated is a side view of a well system 800 of FIG. 14A, after the coupling mechanism 935 has sheared and the conveyance 910 has been pulled further uphole. In at least one embodiment, any one of a compressive force, tensile force or torsional force may shear the coupling mechanism 935. Accordingly, at this stage, the combined bit assembly 1310 is no longer axially or rotationally fixed to the whipstock assembly 970.

Figure 15B:
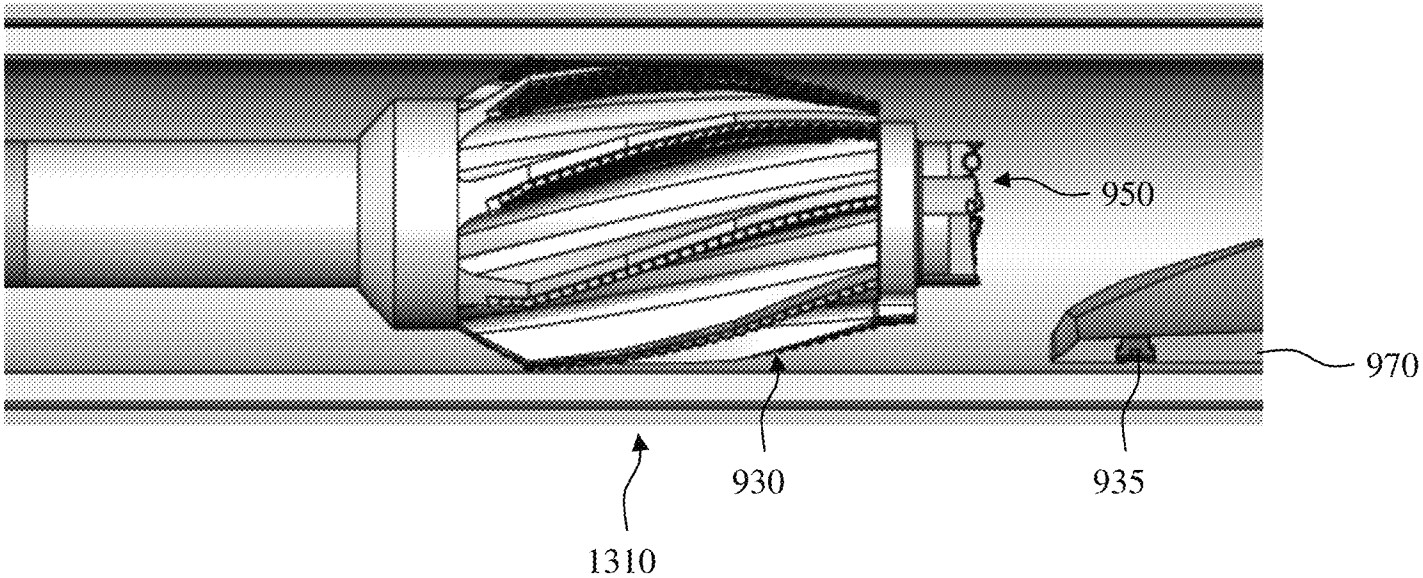

Turning now to FIG. 15B, illustrated is an enlarged side view of the combined bit assembly 1310 of FIG. 15A after it is no longer coupled to the whipstock assembly 970.

Figure 16A:
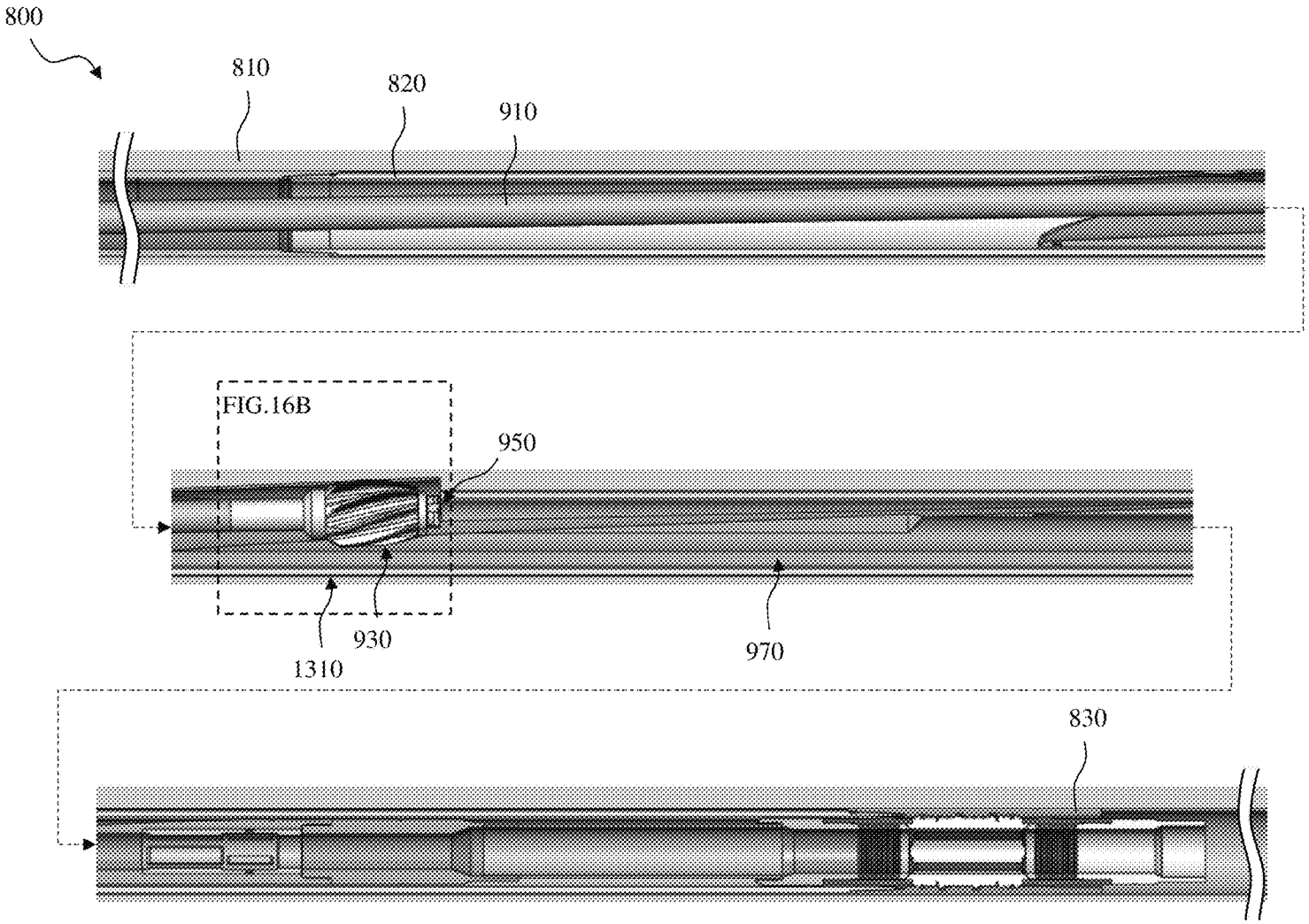
FIGS. 16A and 16B illustrate various different views of a well system, the well system employing a two part drilling and running tool, for example to form a lateral wellbore therein.

Turning to FIG. 16A, illustrated is a side view of a well system 800 of FIG. 15A, after the conveyance 910 and combined bit assembly 1310 are being pushed back downhole to mill at least a portion of the tubing string 820 to form an exit therein. Those skilled in the art understand and appreciate the steps necessary to mill the exit, particularly given the details contained herein.

Figure 16B:
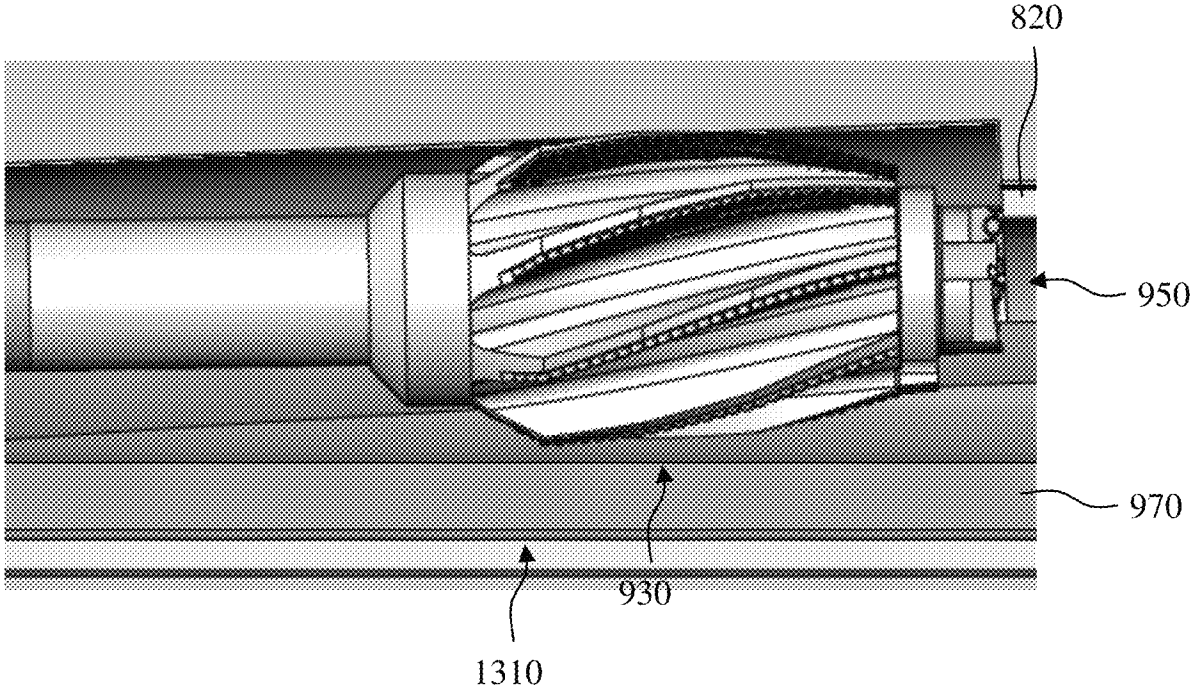

Turning now to FIG. 16B, illustrated is an enlarged side view of the combined bit assembly 1310 of FIG. 16A just starting to form the exit in the tubing string 820.

Figure 17A:
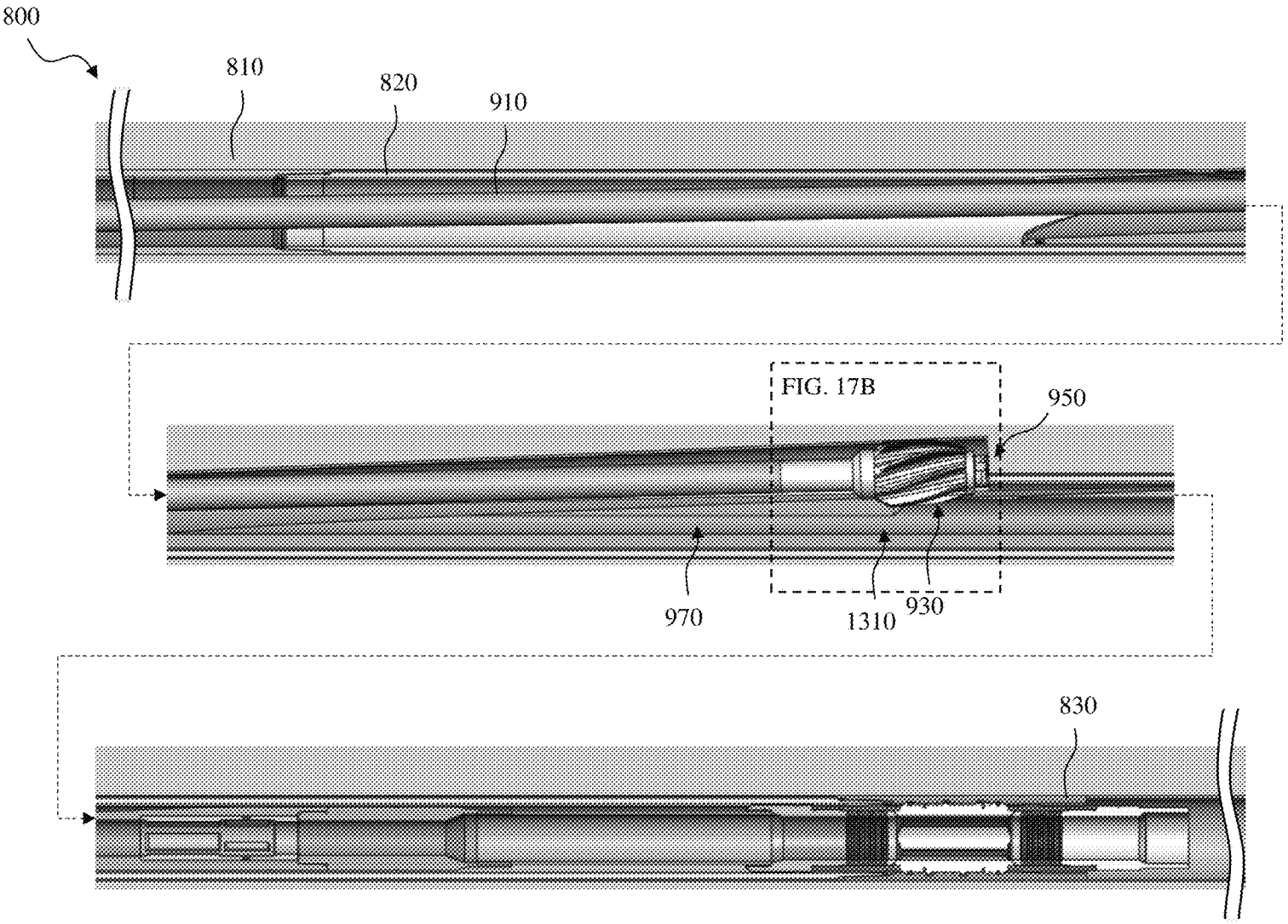
FIGS. 17A and 17B illustrate various different views of a well system, the well system employing a two part drilling and running tool, for example to form a lateral wellbore therein.

Turning to FIG. 17A, illustrated is a side view of a well system 800 of FIG. 16A, after the conveyance 910 and combined bit assembly 1310 continue to mill at least a portion of the tubing string 820 to form the exit therein.

Figure 17B:
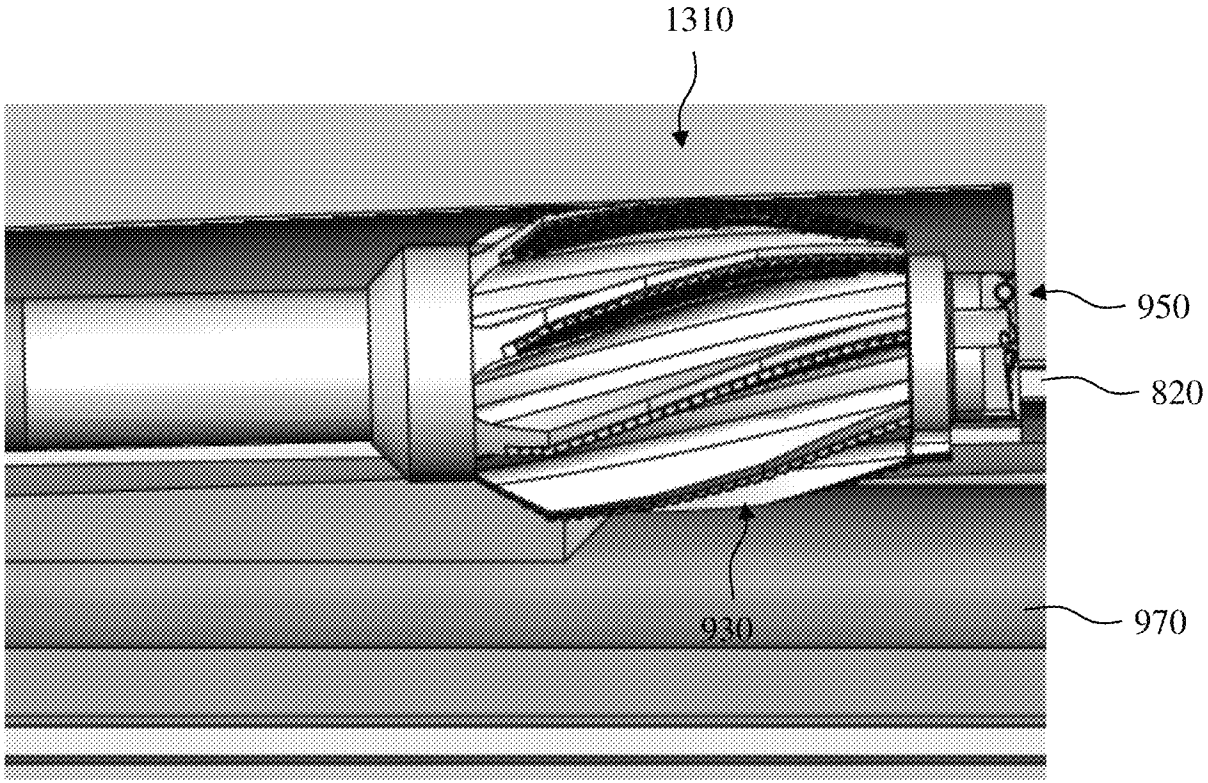

Turning now to FIG. 17B, illustrated is an enlarged side view of the combined bit assembly 1310 of FIG. 17A after continuing to form the exit in the tubing string 820.

Figure 18A:
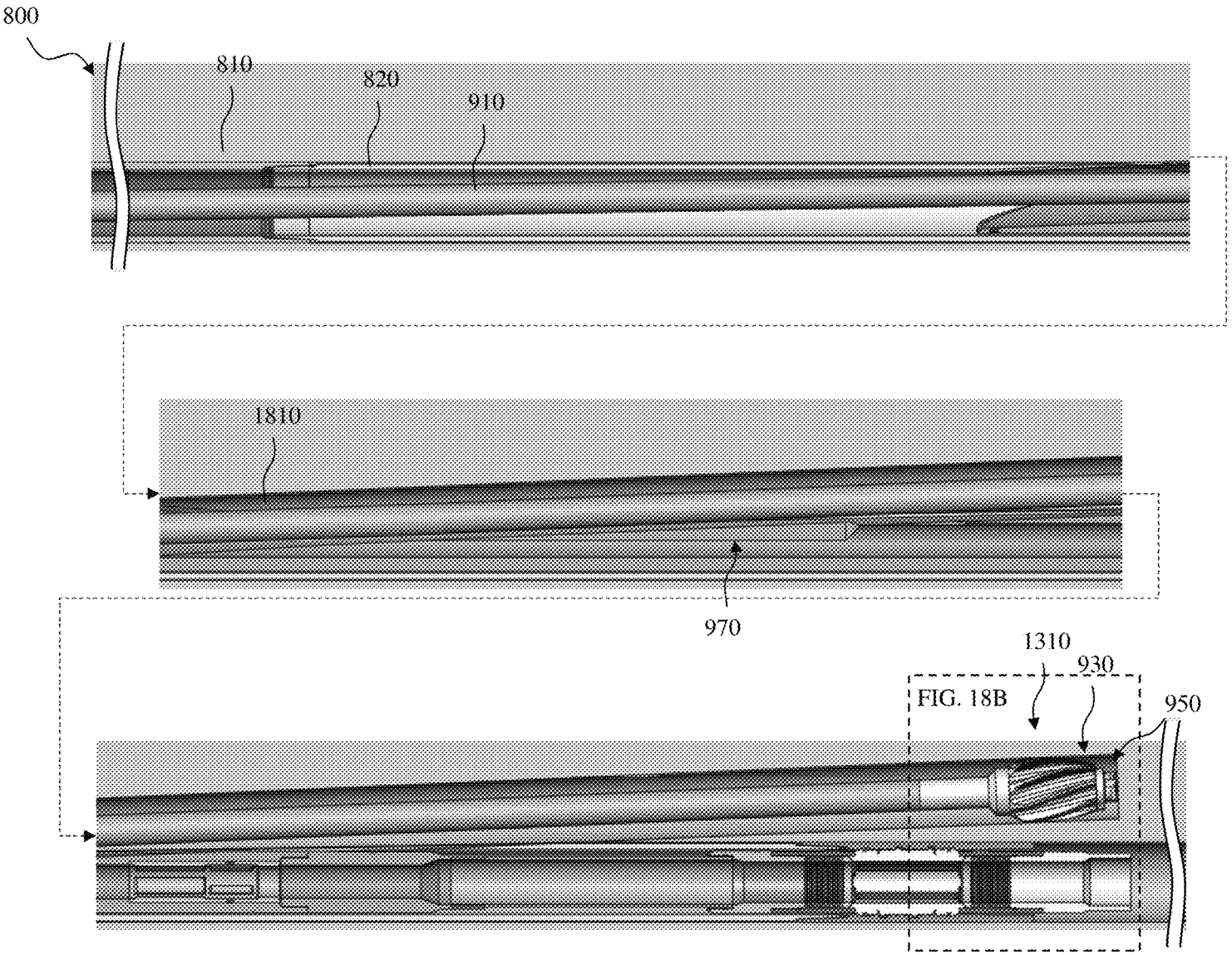
FIGS. 18A and 18B illustrate various different views of a well system, the well system employing a two part drilling and running tool, for example to form a lateral wellbore therein.

Turning to FIG. 18A, illustrated is a side view of a well system 800 of FIG. 17A, after the conveyance 910 and combined bit assembly 1310 have finished forming the exit in the tubing string 820 and then begin to form a rat hole 1810 in the subterranean formation.

Figure 18B:
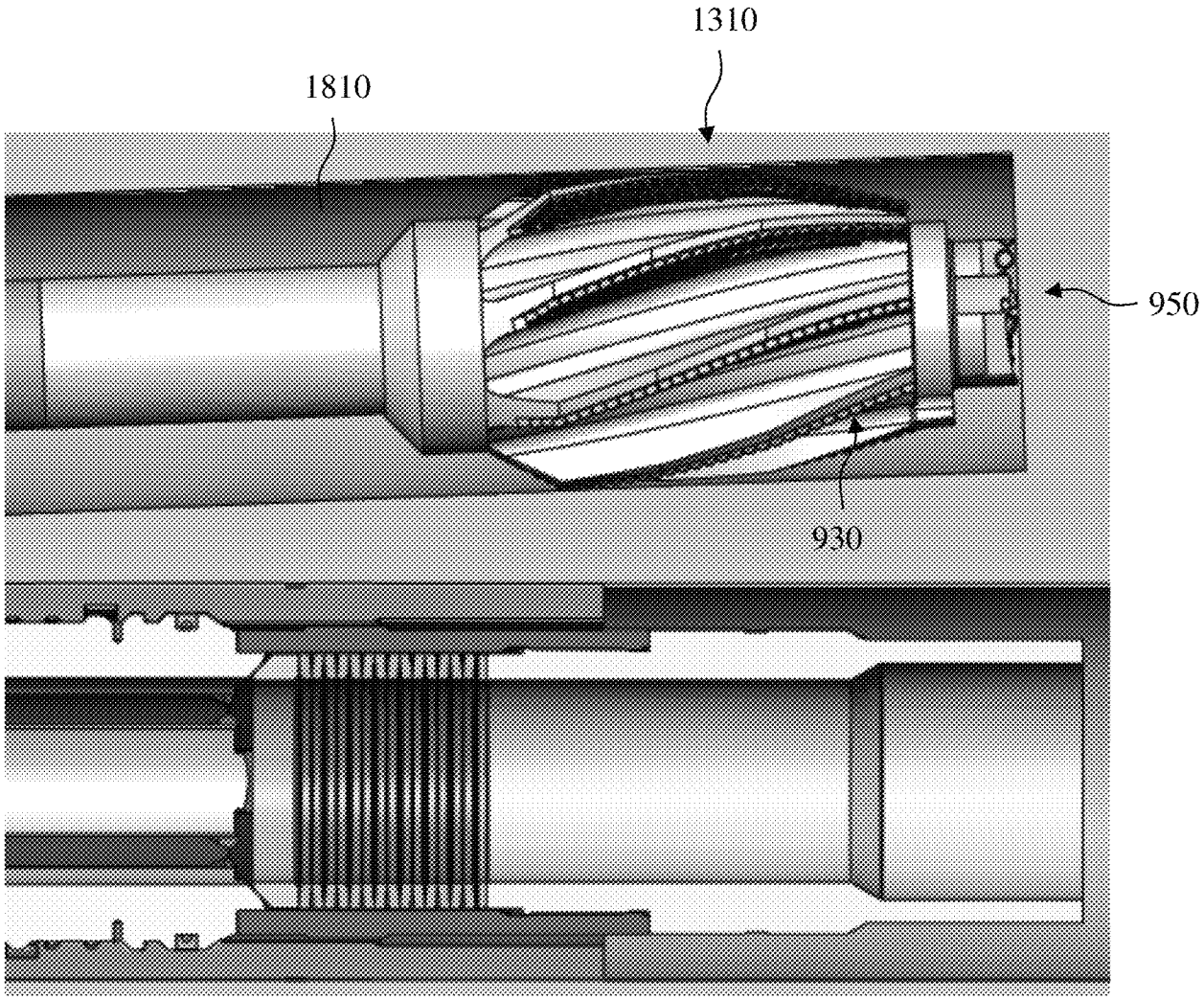

Turning now to FIG. 18B, illustrated is an enlarged side view of the combined bit assembly 1310 of FIG. 18A after beginning to form a rat hole 1810 in the subterranean formation.

Figure 19:
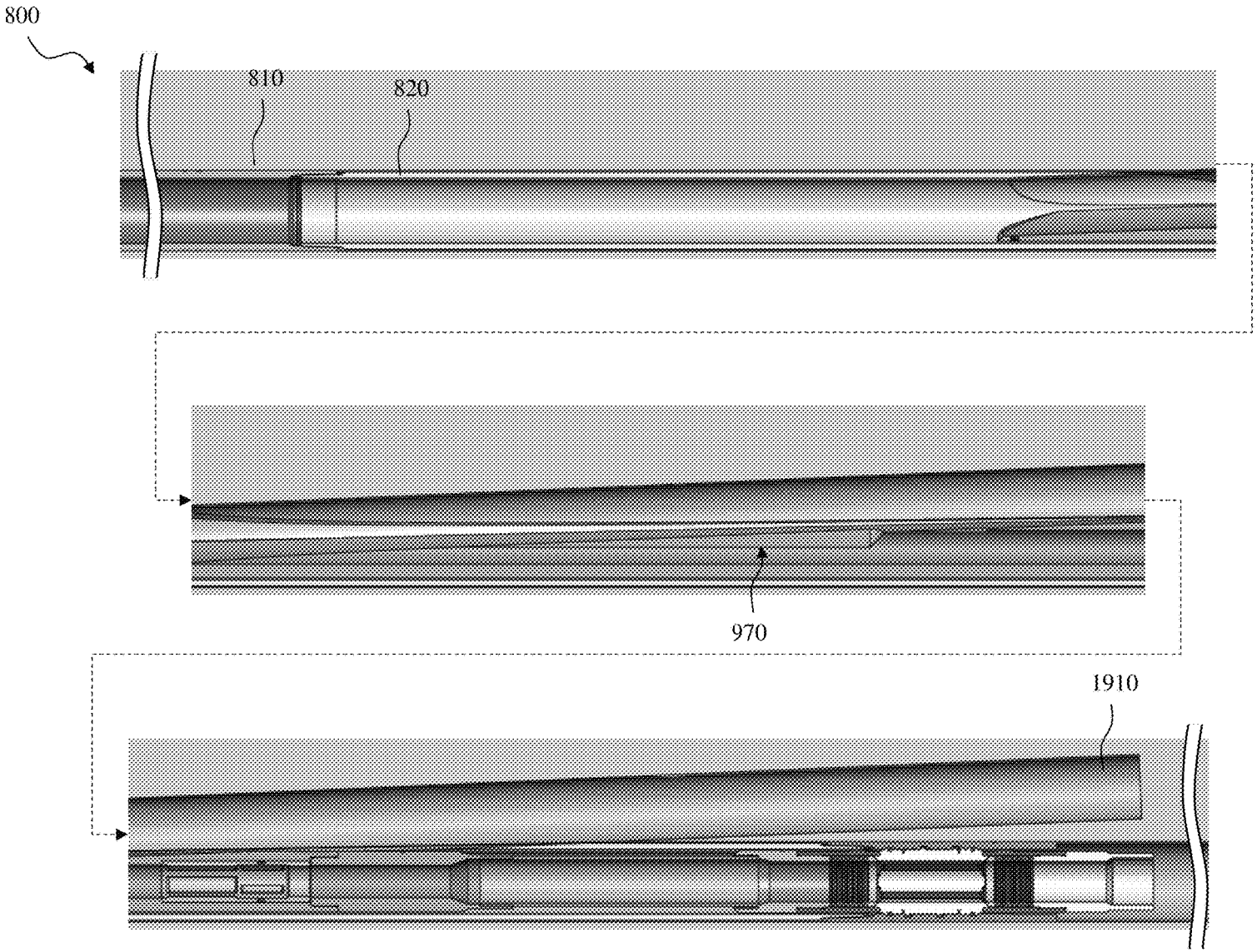
FIG. 19 illustrates various different views of a well system, the well system employing a two part drilling and running tool, for example to form a lateral wellbore therein.

Turning to FIG. 19, illustrated is a side view of a well system 800 of FIG. 18A, after the conveyance 910 and combined bit assembly 1310 have been removed from the well system 800, leaving a completed lateral wellbore 1910.

Aspects disclosed herein include:

A. A two part drilling and running tool, the two part drilling and running tool including: 1) a conveyance; 2) a smaller assembly coupled to an end of the conveyance; and 3) a larger bit assembly slidably coupled to the conveyance, the smaller assembly and larger bit assembly configured to slidingly engage one another downhole to form a combined bit assembly.

B. A well system, the well system including: 1) a main wellbore located within a subterranean formation; 2) a whipstock assembly positioned within the subterranean formation; and 3) a two part drilling and running tool positioned within the main wellbore, the two part drilling and running tool including: a) a conveyance; b) a smaller assembly coupled to an end of the conveyance; and c) a larger bit assembly slidably coupled to the conveyance, the smaller assembly and larger bit assembly configured to slidingly engage one another downhole to form a combined bit assembly.

C. A method for forming a well system, the method including: 1) forming a main wellbore within a subterranean formation; and 2) positioning a two part drilling and running tool within the main wellbore, the two part drilling and running tool coupled to a whipstock assembly using a coupling mechanism, the two part drilling and running tool including: a) a conveyance; b) a smaller assembly coupled to an end of the conveyance; and c) a larger bit assembly slidably coupled to the conveyance, the smaller assembly and larger bit assembly configured to slidingly engage one another downhole to form a combined bit assembly.

Aspects A, B, and C may have one or more of the following additional elements in combination: Element 1: wherein the smaller assembly is a smaller bit assembly. Element 2: wherein the smaller bit assembly includes one or more blades and one or more cutting features along a nose thereof. Element 3: wherein the smaller bit assembly is configured to have a run-in-hole position that has the smaller bit assembly spaced apart from the larger bit assembly by a distance ($D_0$) of at least 2 meters. Element 4: wherein the smaller bit assembly is configured to have a run-in-hole position that has the smaller bit assembly spaced apart from the larger bit assembly by a distance ($D_0$) of at least 4 meters. Element 5: wherein the smaller bit assembly includes one or more first profiles and the larger bit assembly includes one or more second profiles, and further wherein the one or more first profiles are configured to engage with the one or more second profiles to rotationally fix the smaller bit assembly with the larger bit assembly when the two are slidingly engaged together. Element 6: wherein the one or more first profiles are one or more external profiles and the one or more second profiles are one or more internal profiles. Element 7: wherein the smaller bit assembly includes one of a lock ring profile or a lock ring, and the larger bit assembly includes an other of the lock ring or the lock ring profile, the lock ring profile and lock ring configured to engage with one another to slidingly fix the smaller bit assembly with the larger bit assembly when the two are slidingly engaged together. Element 8: wherein the smaller bit assembly includes the lock ring profile and the larger bit assembly includes the lock ring. Element 9: wherein the smaller bit assembly includes one or more shear profiles, the one or more shear profiles configured to house one or more shear features configured to removably couple the smaller bit assembly to a whipstock assembly. Element 10: wherein the smaller bit assembly includes one or more fluid ports, the one or more fluid ports configured to provide fluid access downhole of the smaller bit assembly. Element 11: wherein the whipstock assembly includes a through bore, and further wherein the smaller bit assembly extends into the through bore. Element 12: wherein the smaller bit assembly is axially and rotationally coupled to the whipstock assembly. Element 13: wherein the smaller bit assembly includes one or more first profiles and the whipstock assembly includes one or more second profiles, and further wherein the one or more first profiles are configured to engage with the one or more second profiles to fix the smaller bit assembly with the whipstock assembly. Element 14: wherein the one or more first profiles are one or more external profiles and the one or more second profiles are one or more internal profiles. Element 15: wherein the one or more external profiles and the one or more internal profiles axially and rotationally fix the smaller bit assembly and the whipstock assembly except when subjected to only one of compression, tension or torque. Element 16: wherein the smaller bit assembly is coupled to the whipstock assembly using the coupling mechanism. Element 17: further including applying force to the smaller bit assembly to shear the coupling mechanism, and then sliding the smaller bit assembly relative to the larger bit assembly to form a combined bit assembly. Element 18: wherein the smaller bit assembly and the whipstock assembly are coupled together such that only one of compression, tension or torque may be used to disengage the coupling mechanism. Element 19: wherein only torque may be used to disengage the coupling mechanism. Element 20: wherein the larger bit assembly is removably coupled to the whipstock assembly so that the smaller bit assembly may slide relative to the larger bit assembly to form the combined bit assembly after applying force. Element 21: further including milling casing located within the main wellbore using the combined bit assembly. Element 22: further including drilling a lateral wellbore off of the main wellbore using the combined bit assembly.

Those skilled in the art to which this application relates will appreciate that other and further additions, deletions, substitutions and modifications may be made to the described embodiments.

What is claimed is:

1. A two part drilling and running tool, comprising:

a conveyance;

a smaller assembly coupled to an end of the conveyance, wherein the smaller assembly is a smaller bit assembly including one or more blades and one or more cutting features along a nose thereof; and a larger bit assembly slidably coupled to the conveyance, the smaller assembly and larger bit assembly configured to slidingly engage one another downhole to form a combined bit assembly.

2. The two part drilling and running tool as recited in claim 1, wherein the smaller bit assembly is configured to have a run-in-hole position that has the smaller bit assembly spaced apart from the larger bit assembly by a distance ($D_0$) of at least 2 meters.

3. The two part drilling and running tool as recited in claim 1, wherein the smaller bit assembly is configured to have a run-in-hole position that has the smaller bit assembly spaced apart from the larger bit assembly by a distance ($D_0$) of at least 4 meters.

4. The two part drilling and running tool as recited in claim 1, wherein the smaller bit assembly includes one or more first profiles and the larger bit assembly includes one or more second profiles, and further wherein the one or more first profiles are configured to engage with the one or more second profiles to rotationally fix the smaller bit assembly with the larger bit assembly when the two are slidingly engaged together.

5. The two part drilling and running tool as recited in claim 4, wherein the one or more first profiles are one or more external profiles and the one or more second profiles are one or more internal profiles.

6. The two part drilling and running tool as recited in claim 1, wherein the smaller bit assembly includes one of a lock ring profile or a lock ring, and the larger bit assembly includes an other of the lock ring or the lock ring profile, the lock ring profile and lock ring configured to engage with one another to slidingly fix the smaller bit assembly with the larger bit assembly when the two are slidingly engaged together.

7. The two part drilling and running tool as recited in claim 6, wherein the smaller bit assembly includes the lock ring profile and the larger bit assembly includes the lock ring.

8. The two part drilling and running tool as recited in claim 1, wherein the smaller bit assembly includes one or more shear profiles, the one or more shear profiles configured to house one or more shear features configured to removably couple the smaller bit assembly to a whipstock assembly.

9. The two part drilling and running tool as recited in claim 1, wherein the smaller bit assembly includes one or more fluid ports, the one or more fluid ports configured to provide fluid access downhole of the smaller bit assembly.

10. A well system, comprising:

a main wellbore located within a subterranean formation;

a whipstock assembly positioned within the subterranean formation; and a two part drilling and running tool positioned within the main wellbore, the two part drilling and running tool including:

a conveyance;

a smaller assembly coupled to an end of the conveyance, wherein the smaller assembly is a smaller bit assembly including one or more blades and one or more cutting features along a nose thereof; and a larger bit assembly slidably coupled to the conveyance, the smaller assembly and larger bit assembly configured to slidingly engage one another downhole to form a combined bit assembly.

11. The well system as recited in claim 10, wherein the smaller bit assembly is configured to have a run-in-hole position that has the smaller bit assembly spaced apart from the larger bit assembly by a distance ($D_0$) of at least 2 meters.

12. The well system as recited in claim 10, wherein the smaller bit assembly is configured to have a run-in-hole position that has the smaller bit assembly spaced apart from the larger bit assembly by a distance ($D_0$) of at least 4 meters.

13. The well system as recited in claim 10, wherein the smaller bit assembly includes one or more first profiles and the larger bit assembly includes one or more second profiles, and further wherein the one or more first profiles are configured to engage with the one or more second profiles to rotationally fix the smaller bit assembly with the larger bit assembly when the two are slidingly engaged together.

14. The well system as recited in claim 13, wherein the one or more first profiles are one or more external profiles and the one or more second profiles are one or more internal profiles.

15. The well system as recited in claim 10, wherein the smaller bit assembly includes one of a lock ring profile or a lock ring, and the larger bit assembly includes an other of the lock ring or the lock ring profile, the lock ring profile and lock ring configured to engage with one another to slidingly fix the smaller bit assembly with the larger bit assembly when the two are slidingly engaged together.

16. The well system as recited in claim 15, wherein the smaller bit assembly includes the lock ring profile and the larger bit assembly includes the lock ring.

17. The well system as recited in claim 10, wherein the smaller bit assembly includes one or more shear profiles, the one or more shear profiles configured to house one or more shear features configured to removably couple the smaller bit assembly to a whipstock assembly.

18. The well system as recited in claim 10, wherein the smaller bit assembly includes one or more fluid ports, the one or more fluid ports configured to provide fluid access downhole of the smaller bit assembly.

19. The well system as recited in claim 10, wherein the whipstock assembly includes a through bore, and further wherein the smaller bit assembly extends into the through bore.

20. The well system as recited in claim 19, wherein the smaller bit assembly is axially and rotationally coupled to the whipstock assembly.

21. The well system as recited in claim 20, wherein the smaller bit assembly includes one or more first profiles and the whipstock assembly includes one or more second profiles, and further wherein the one or more first profiles are configured to engage with the one or more second profiles to fix the smaller bit assembly with the whipstock assembly.

22. The well system as recited in claim 21, wherein the one or more first profiles are one or more external profiles and the one or more second profiles are one or more internal profiles.

23. The well system as recited in claim 22, wherein the one or more external profiles and the one or more internal profiles axially and rotationally fix the smaller bit assembly and the whipstock assembly except when subjected to only one of compression, tension or torque.

24. A method for forming a well system, comprising:

forming a main wellbore within a subterranean formation; and positioning a two part drilling and running tool within the main wellbore, the two part drilling and running tool coupled to a whipstock assembly using a coupling mechanism, the two part drilling and running tool including:

a conveyance;

a smaller assembly coupled to an end of the conveyance, wherein the smaller assembly is a smaller bit assembly including one or more blades and one or more cutting features along a nose thereof; and a larger bit assembly slidably coupled to the conveyance, the smaller assembly and larger bit assembly configured to slidingly engage one another downhole to form a combined bit assembly.

25. The method as recited in claim 24, wherein the smaller bit assembly is coupled to the whipstock assembly using the coupling mechanism.

26. The method as recited in claim 25, further including applying force to the smaller bit assembly to shear the coupling mechanism, and then sliding the smaller bit assembly relative to the larger bit assembly to form a combined bit assembly.

27. The method as recited in claim 26, wherein the smaller bit assembly and the whipstock assembly are coupled together such that only one of compression, tension or torque may be used to disengage the coupling mechanism.

28. The method as recited in claim 27, wherein only torque may be used to disengage the coupling mechanism.

29. The method as recited in claim 26, wherein the larger bit assembly is removably coupled to the whipstock assembly so that the smaller bit assembly may slide relative to the larger bit assembly to form the combined bit assembly after applying force.

30. The method as recited in claim 26, further including milling casing located within the main wellbore using the combined bit assembly.

31. The method as recited in claim 26, further including drilling a lateral wellbore off of the main wellbore using the combined bit assembly.

32. A two part drilling and running tool, comprising:

a conveyance;

a smaller assembly coupled to an end of the conveyance, wherein the smaller assembly is a smaller bit assembly including one or more shear profiles, the one or more shear profiles configured to house one or more shear features configured to removably couple the smaller bit assembly to a whipstock assembly; and a larger bit assembly slidably coupled to the conveyance, the smaller assembly and larger bit assembly configured to slidingly engage one another downhole to form a combined bit assembly.

33. A two part drilling and running tool, comprising:

a conveyance;

a smaller assembly coupled to an end of the conveyance, wherein the smaller assembly is a smaller bit assembly including one or more fluid ports, the one or more fluid ports configured to provide fluid access downhole of the smaller bit assembly; and a larger bit assembly slidably coupled to the conveyance, the smaller assembly and larger bit assembly configured to slidingly engage one another downhole to form a combined bit assembly.

* * * * *